US010443551B2

(12) United States Patent
Hayashi

(10) Patent No.: US 10,443,551 B2
(45) Date of Patent: Oct. 15, 2019

(54) PRESSURE REGULATOR AND FUEL SUPPLY DEVICE

(71) Applicant: DENSO CORPORATION, Kariya, Aichi-pref. (JP)

(72) Inventor: Norihiro Hayashi, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 16/211,733

(22) Filed: Dec. 6, 2018

(65) Prior Publication Data

US 2019/0107088 A1 Apr. 11, 2019

Related U.S. Application Data

(63) Continuation of application No. PCT/JP2017/017509, filed on May 9, 2017.

(30) Foreign Application Priority Data

Jun. 14, 2016 (JP) ..... 2016-118359

(51) Int. Cl.

| | |
|---|---|
| ***F02M 37/00*** | (2006.01) |
| *F02M 63/02* | (2006.01) |
| *F02M 63/00* | (2006.01) |
| *F02M 69/54* | (2006.01) |

(52) U.S. Cl.

CPC ..... *F02M 37/0029* (2013.01); *F02M 37/00* (2013.01); *F02M 37/0052* (2013.01); *F02M 63/005* (2013.01); *F02M 63/023* (2013.01); *F02M 63/0235* (2013.01); *F02M 69/54* (2013.01)

(58) Field of Classification Search

CPC ..... F02M 37/0029; F02M 37/0052; F02M 37/00; F02M 69/54; F02M 63/005; F02M 63/023; F02M 63/0235

USPC ..... 123/511

See application file for complete search history.

(56) References Cited

U.S. PATENT DOCUMENTS

| | | | | |
|---|---|---|---|---|
| 4,310,142 | A | 1/1982 | Ludwig | |
| 5,558,068 | A * | 9/1996 | Kunishima | F02D 33/006 123/179.17 |
| 2007/0227511 | A1 | 10/2007 | Hazama et al. | |
| 2009/0107471 | A1 * | 4/2009 | Ikeya | F02M 37/0029 123/511 |

(Continued)

FOREIGN PATENT DOCUMENTS

| | | | | |
|---|---|---|---|---|
| JP | 63032160 | A * | 2/1988 | F02M 69/54 |
| JP | 63041665 | A * | 2/1988 | F02M 69/54 |
| JP | 64-032066 | | 2/1989 | |

(Continued)

*Primary Examiner* — Mahmoud Gimie
*Assistant Examiner* — Joshua Campbell
(74) *Attorney, Agent, or Firm* — Nixon & Vanderhye, P.C.

(57) ABSTRACT

A valve member is movable with first and second partition member and opens and closes a first pressure chamber with respect to a return passage. The first partition member partitions the first pressure chamber from a second pressure chamber. The second partition member partitions the second pressure chamber from a third pressure chamber. The first, second, and third pressure chambers cause fuel from a fuel flow passage to flow therethrough. A switching unit switches an opening and closing state of the second pressure chamber and the third pressure chamber with respect to the fuel flow passage and the return passage.

12 Claims, 27 Drawing Sheets

(56) References Cited

U.S. PATENT DOCUMENTS

| | | | | |
|---|---|---|---|---|
| 2011/0146627 | A1 | 6/2011 | Oohashi et al. | |
| 2011/0297126 | A1 * | 12/2011 | Akagi | F02M 37/0029 123/457 |

FOREIGN PATENT DOCUMENTS

| | | | | |
|---|---|---|---|---|
| JP | 8-144888 | | | 6/1996 |
| JP | 2002-235622 | | | 8/2002 |
| JP | 2002-310025 | | | 10/2002 |
| JP | 2002310025 | A | * | 10/2002 |
| JP | 2010-255458 | | | 11/2010 |
| JP | 2011-190686 | | | 9/2011 |
| JP | 2011190686 | A | * | 9/2011 |
| JP | 5472738 | | | 4/2014 |

* cited by examiner

FIG. 3

| MODE | FUEL PRESSURE IN FUEL FLOW PASSAGE | OPENING AND CLOSING STATE OF FUEL FLOW PASSAGE | | OPENING AND CLOSING STATE FOR RETURN PASSAGE | |
|---|---|---|---|---|---|
| | | SECOND PRESSURE CHAMBER | THIRD PRESSURE CHAMBER | SECOND PRESSURE CHAMBER | THIRD PRESSURE CHAMBER |
| FIRST MODE M1 | P1 | CLOSED | CLOSED | OPEN | OPEN |
| SECOND MODE M2 | P2 | OPEN (P2) | CLOSED | CLOSED | OPEN |
| THIRD MODE M3 | P3 | CLOSED | OPEN (P3) | OPEN | CLOSED |

FIG. 8

| MODE | FUEL PRESSURE IN FUEL FLOW PASSAGE | OPENING AND CLOSING STATE OF FUEL FLOW PASSAGE | OPENING AND CLOSING STATE FOR RETURN PASSAGE |
|---|---|---|---|
| | | THIRD PRESSURE CHAMBER | THIRD PRESSURE CHAMBER |
| FIRST MODE M1 | P1 | CLOSED | OPEN |
| SECOND MODE M2 | P2 | OPEN (P2) | CLOSED |

FIG. 12

| MODE | FUEL PRESSURE IN FUEL FLOW PASSAGE | OPENING AND CLOSING STATE OF FUEL FLOW PASSAGE | OPENING AND CLOSING STATE FOR RETURN PASSAGE |
|---|---|---|---|
| | | SECOND PRESSURE CHAMBER | SECOND PRESSURE CHAMBER |
| FIRST MODE M1 | P1 | CLOSED | OPEN |
| SECOND MODE M2 | P2 | OPEN (P2) | CLOSED |

PRESSURE REGULATOR AND FUEL SUPPLY DEVICE

CROSS REFERENCE TO RELATED APPLICATION

The present application is a continuation application of International Patent Application No. PCT/JP2017/017509 filed on May 9, 2017, which designated the U.S. and claims the benefit of priority from Japanese Patent Application No. 2016-118359 filed on Jun. 14, 2016. The entire disclosures of all of the above applications are incorporated herein by reference.

TECHNICAL FIELD

The present disclosure relates to a pressure regulator configured to regulate a fuel pressure in a fuel flow passage.

BACKGROUND ART

A conventional internal combustion system includes a fuel supply device including a fuel pump to pump fuel from a fuel tank to an internal combustion engine through a fuel flow passage. The fuel supply device may include a pressure regulator configured to regulate a fuel pressure in the fuel flow passage.

SUMMARY OF INVENTION

According to an aspect of the present disclosure, a pressure regulator is configured to release fuel from a fuel flow passage into a fuel tank through a return passage to regulate a fuel pressure in the fuel flow passage. The fuel flow passage is configured to cause fuel pumped by a fuel pump in a fuel tank to flow toward an internal combustion engine. The pressure regulator comprises a first pressure chamber configured to cause fuel branched from the fuel flow passage to flow therethrough. The pressure regulator further comprises a second pressure chamber adjacent to the first pressure chamber and configured to cause fuel branched from the fuel flow passage to flow therethrough. The pressure regulator further comprises a third pressure chamber adjacent to the second pressure chamber and configured to cause fuel branched from the fuel flow passage to flow therethrough. The pressure regulator further comprises a valve member configured to open and close the first pressure chamber with respect to the return passage. The pressure regulator further comprises a first partition member configured to move with the valve member in a state where the first partition member and the second partition member are partitioned from each other. The pressure regulator further comprises a second partition member configured to move with the valve member and the first partition member in a state where the second pressure chamber and the third pressure chamber are partitioned from each other. The pressure regulator further comprises a switching unit configured to switch an opening and closing state of at least one of the first pressure chamber, the second pressure chamber, and the third pressure chamber with respect to at least one of the fuel flow passage and the return passage.

BRIEF DESCRIPTION OF THE DRAWINGS

The above and other objects, features and advantages of the present disclosure will become more apparent from the following detailed description made with reference to the accompanying drawings. In the drawings:

FIG. 3 is a characteristic diagram illustrating the overall operation of the pressure regulator according to at least one embodiment;

FIG. 8 is a characteristic diagram illustrating the overall operation of the pressure regulator according to at least one embodiment;

FIG. 12 is a characteristic diagram illustrating the overall operation of the pressure regulator according to at least one embodiment;

DESCRIPTION OF EMBODIMENTS

Figure 1:
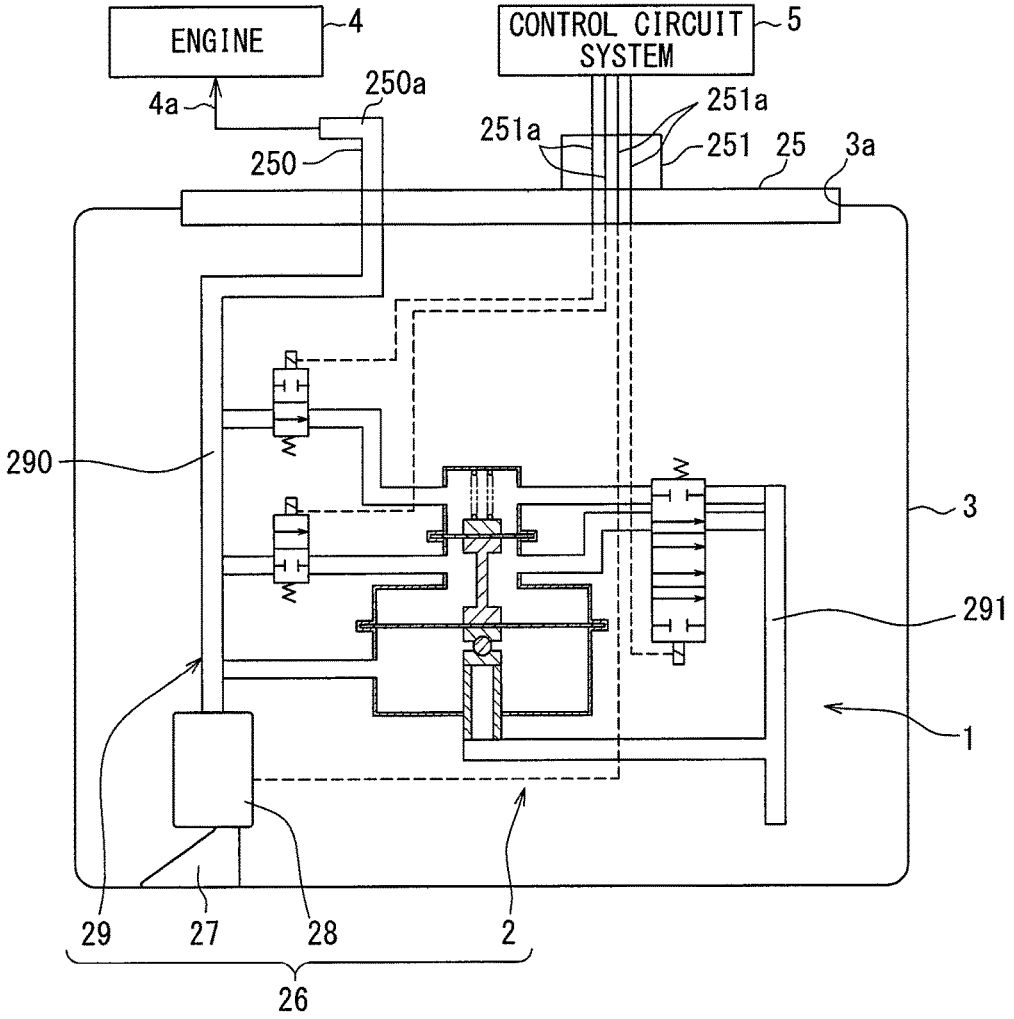
FIG. 1 is an overall configuration diagram showing a fuel supply device according to at least one embodiment.

To begin with, examples of relevant techniques will be described.

A pressure regulator has, for example, multiple pressure chambers each configured to receive fuel branched from a fuel flow passage and to release fuel into a return passage. The fuel flow passage causes fuel to flow therethrough from a fuel tank to an internal combustion engine. The return passage leads fuel to the fuel tank.

A pressure regulator may have a first pressure chamber, a second pressure chamber, and a third pressure chamber. The first pressure chamber and the second pressure chamber are adjacent to each other and are partitioned from each other by using a first diaphragm. The second pressure chamber and the third pressure chamber are adjacent to each other and are partitioned from each other by using a second diaphragm. In this example, the pressure regulator may include a valve member configured to move with the first and second diaphragms and to open and close the first pressure chamber with respect to the return passage. The pressure regulator may further include a three-way valve to switch an opening and closing state of each of the second and third pressure chambers with respect to the fuel flow passage. Thus, the pressure regulator is configured to control a flow rate of fuel released from the first pressure chamber to the return passage in accordance with a switching position of the three-way valve, thereby to regulate the fuel pressure in the fuel flow passage.

Further detailed examples may be conceivable. In a first conceivable example, the second and third pressure chambers may be opened into the fuel tank through a throttle. In the first conceivable example, the fuel pump may be required to perform an extra pumping work as much as fuel constantly released from the second and third pressure chambers. Consequently, the first conceivable example may not sufficiently achieve a fuel efficiency.

In a second conceivable example, the second and third pressure chambers may be regularly closed with respect to the return passage. In the second conceivable example, even if the opening and closing state of each of the second and third pressure chambers with respect to the fuel flow passage is switched by using the three-way valve, each of the pressure chambers hardly change rapidly from the fuel pressure before switching. Consequently, the second conceivable example may hardly achieve a responsiveness and a pressure regulation accuracy.

Hereinafter, embodiments of the present disclosure will be described with reference to the drawings. The same reference numerals are assigned to the corresponding components in each embodiment, and duplicate descriptions may be omitted. When only a part of a configuration is described in each embodiment, a configuration of the other embodiments described above can be applied to other parts of the configuration. Further, not only the combinations of the configurations explicitly shown in the description of the respective embodiments, but also the configurations of the plurality of embodiments can be partially combined even if they are not explicitly shown if there is no problem in the combination in particular.

(First Embodiment)

As shown in FIG. 1, a fuel supply device 1 provided with a pressure regulator 2 according to an embodiment of the present disclosure is applied to an internal combustion engine 4 of a vehicle by being mounted on a fuel tank 3. The fuel supply device 1 supplies a fuel stored in the fuel tank 3 in the vehicle to the internal combustion engine 4 outside the fuel tank 3. An insertion hole 3*a* penetrates through an upper wall of the fuel tank 3. The fuel supply device 1 is inserted into the fuel tank 3 through the insertion hole 3*a*. The internal combustion engine 4 to which the fuel is supplied from the fuel supply device 1 under such an insertion state may be a gasoline engine or a diesel engine.

The fuel supply device 1 includes a lid 25 and a pump unit 26. The lid 25 is assembled to the upper wall of the fuel tank 3. With the above assembly, the lid 25 closes the insertion hole 3*a*. The lid 25 integrally includes a fuel supply pipe 250 and an electrical connector 251.

The fuel supply pipe 250 has a fuel supply passage 250*a* formed internally. In the fuel tank 3, the fuel supply passage 250*a* communicates with a fuel flow passage 290 of the pump unit 26. Outside the fuel tank 3, the fuel supply passage 250*a* communicates with a fuel transfer passage 4*a* of the internal combustion engine 4. In such a communication state, the fuel in the fuel tank 3 is pumped up by the fuel pump 28 of the pump unit 26, and is supplied from the fuel supply passage 250*a* to the fuel transfer passage 4*a* outside the fuel tank 3.

The electrical connector 251 includes multiple terminals 251*a*. In the fuel tank 3, each terminal 251*a* is electrically connected to one of the fuel pump 28 and the pressure regulator 2 of the pump unit 26. On the other hand, outside the fuel tank 3, each terminal 251*a* is electrically connected to a control circuit system 5 such as an ECU. In the above electrical connection condition, the respective operations of the fuel pump 28 and the pressure regulator 2 are controlled by the control circuit system 5.

The pump unit 26 is accommodated below the lid 25 in the fuel tank 3. The pump unit 26 includes a suction filter 27, a fuel pump 28, a passage member 29, and the pressure regulator 2.

The suction filter 27 is formed in a bag shape from a material that exhibits a filtering function, such as a porous resin, a woven fabric, a nonwoven fabric, a resin mesh, or a metal mesh. The suction filter 27 filters the fuel passing from an interior of the fuel tank 3 into an inner space of the suction filter 27.

The fuel pump 28 is, for example, an electric pump such as a vane pump or a trochoid pump. An intake port of the fuel pump 28 communicates with an inner space of the suction filter 27. A discharge port of the fuel pump 28 communicates with the fuel transfer passage 4*a* of the internal combustion engine 4 through the fuel flow passage 290 in the passage member 29 and the fuel supply passage 250*a* in the fuel supply pipe 250. The fuel pump 28 is electrically connected to the control circuit system 5 through the terminals 251*a* of the electrical connector 251, and operates in accordance with control by the control circuit system 5. As a result, the fuel pump 28 filters the fuel in the fuel tank 3 by the suction filter 27, and then draws the fuel.

The fuel thus drawn is pumped up by the fuel pump 28 and then discharged, thereby being pumped up to the fuel flow passage 290.

The passage member 29 internally provides the fuel flow passage 290 and the return passage 291. The fuel flow passage 290 communicates with the discharge port of the fuel pump 28 and the fuel supply passage 250*a* of the fuel supply pipe 250, thereby allowing the fuel pumped by the fuel pump 28 to flow toward the internal combustion engine 4. The return passage 291 communicates with the pressure regulator 2 and the inside of the fuel tank 3, thereby returning the release fuel from the pressure regulator 2 to the inside of the fuel tank 3.

The pressure regulator 2 is a diaphragm type fuel pressure regulating valve. The pressure regulator 2 communicates with the fuel flow passage 290 and a return passage 291. The pressure regulator 2 is electrically connected to the control circuit system 5 through the terminals 251*a* of the electrical connector 251, and operates in accordance with control by the control circuit system 5. As a result, the pressure regulator 2 regulates the fuel pressure in the fuel flow passage 290 by allowing a part of the fuel supplied to the internal combustion engine 4 side to release from the fuel flow passage 290 into the fuel tank 3 through the return passage 291.

(Detailed Configuration of Pressure Regulator)

Next, a detailed configuration of the pressure regulator 2 will be described.

Figure 2:
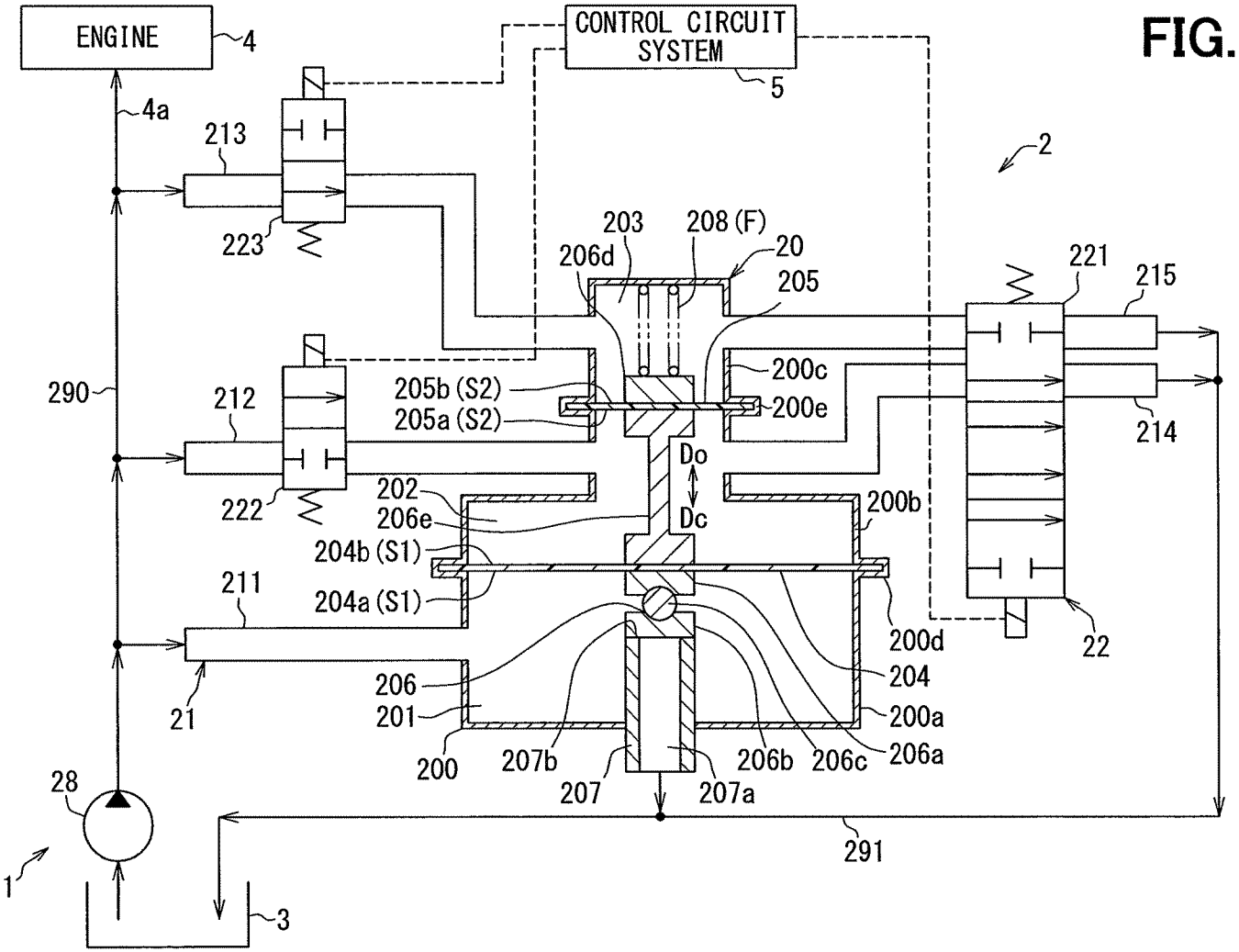
FIG. 2 is a detailed configuration diagram showing a pressure regulator according to at least one embodiment.

As shown in FIG. 2, the pressure regulator 2 includes a main unit 20, a passage unit 21, and a switching unit 22. The main unit 20 includes a main body 200, first and second partition members 204 and 205, a valve member 206, a valve seat member 207, and a resilient member 208 in combination.

The main body 200 is formed of multiple metal members in a hollow shape as an overall. The main body 200 has first to third cylindrical portions 200*a*, 200*b*, and 200*c*, and first and second holding portions 200*d* and 200*e*.

The first cylindrical portion 200*a* has a bottomed cylindrical shape in which the second cylindrical portion 200*b* is connected to an end opposite to a bottom portion through the first holding portion 200*d*. The first cylindrical portion 200*a* internally provides a first pressure chamber 201. The second cylindrical portion 200*b* has a cylindrical shape in which the first and third cylindrical portions 200*a* and 200*c* are connected to each other at both ends of the second cylindrical portion 200*b* through the first and second holding portions 200*d* and 200*e*, respectively. The second cylindrical portion 200*b* is internally provided with a second pressure chamber 202 and the second pressure chamber 202 is adjacent to the first pressure chamber 201. The third cylindrical portion 200*c* has an inverted bottomed cylindrical shape in which the second cylindrical portion 200*b* is connected to an end opposite to a bottom portion through the second holding portion 200*e*. The third cylindrical portion 200*c* is internally provided with a third pressure chamber 203 and the third pressure chamber 203 is adjacent to the second pressure chamber 202.

The first holding portion 200*d* is provided at a boundary point between the first cylindrical portion 200*a* surrounding the first pressure chamber 201 and the second cylindrical portion 200*b* surrounding the second pressure chamber 202. The second holding portion 200*e* is provided at a boundary point between the second cylindrical portion 200*b* surrounding the second pressure chamber 202 and the third cylindrical portion 200*c* surrounding the third pressure chamber 203.

The first partition member 204 is a diaphragm having elastically deformable flexibility in the present embodiment. The first partition member 204 is shaped in a circular film made of, for example, a composite material of rubber and base cloth, and has an elastically deformable flexibility. An outer peripheral portion of the first partition member 204 is held by the first holding portion 200*d* over an entire periphery, to thereby separate the first pressure chamber 201 and the second pressure chamber 202 from each other. The first partition member 204 provides a common first pressure receiving area S1 that is substantially the same as each other on both surfaces 204*a* and 204*b* exposed to the first and second pressure chambers 201 and 202, respectively.

The second partition member 205 is a diaphragm having elastically deformable flexibility in the present embodiment. The second partition member 205 is shaped in a circular film made of, for example, a composite material of rubber and a base cloth, and an outer peripheral portion of the second partition member 205 is held by the second holding portion 200*e* over an entire periphery, to thereby separate the second pressure chamber 202 and the third pressure chamber 203 from each other. The second partition member 205 provides a common second pressure receiving area S2 that is substantially the same as each other on both surfaces 205*a* and 205*b* exposed to the second and third pressure chambers 202 and 203, respectively. In this example, the second pressure receiving area S2 according to the present embodiment is set in advance to a value smaller than the first pressure receiving area S1. Therefore, in the present embodiment, with the use of an area comparison coefficient A having a value larger than 1, a correlation between the second pressure receiving area S2 and the first pressure receiving area S1 is expressed by the following Expression 1.

$$S1 = A \cdot S2 \qquad \text{(Expression 1)}$$

The valve member 206 is formed of multiple metal materials in a columnar shape as an overall. The valve member 206 is accommodated across the first to third pressure chambers 201, 202, and 203. The valve member 206 has first and second partition movable portions 206*a* and 206*d*, a valve movable portion 206*b*, a joint movable portion 206*c*, and a coupling movable portion 206*e*.

The first partition movable portion 206*a* has a circular plate-shape positioned coaxially with the first partition member 204 in the first pressure chamber 201. The first partition movable portion 206*a* is attached to a surface 204*a* of the first partition member 204 on the first pressure chamber 201 side so as to be integrally displaceable. The valve movable portion 206*b* has a circular plate-shape positioned coaxially with the first partition movable portion 206*a*. The valve movable portion 206*b* is attached to the first partition movable portion 206*a* through a ball-shaped joint movable portion 206*c*.

The second partition movable portion 206*d* has a circular plate-shape positioned coaxially with the second partition member 205 in the third pressure chamber 203. The second partition movable portion 206*d* is attached to a surface 205*b* of the second partition member 205 on the side of the third pressure chamber 203 so as to be integrally displaceable. The coupling movable portion 206*e* has a columnar shape positioned coaxially with the first and second partition members 204 and 205 in the second pressure chamber 202. One end of the coupling movable portion 206*e* is attached to a surface 204*b* of the first partition member 204 on the second pressure chamber 202 side so as to be integrally displaceable. The other end of the coupling movable portion

206*e* is attached to a surface 205*a* of the second partition member 205 on the second pressure chamber 202 side so as to be integrally displaceable.

The valve member 206 thus configured is reciprocally displaceable in the axial direction in conjunction with the partition members 204 and 205 in a state where the valve member 206 is disposed across three pressure chambers 201, 202, and 203 separated by the first and second partition members 204 and 205. In other words, the first partition member 204 cooperates with the valve member 206 in a state where the first and second pressure chambers 201 and 202 are partitioned from each other, and the second partition member 205 moves with the valve member 206 and the first partition member 204 in a state where the second and third pressure chambers 202 and 203 are partitioned from each other.

The valve seat member 207 is formed in a cylindrical shape as an overall which is made of one or multiple metal materials. The valve seat member 207 is held by the main body 200 and is liquid-tightly penetrated through a bottom portion of the first cylindrical portion 200*a*. The valve seat member 207 is internally provided with a first release passage 207*a*. An outer portion of the valve seat member 207 protruding outside the main body 200 communicates the first release passage 207*a* with the return passage 291. An inner portion of the valve seat member 207, which is exposed by projecting into the first pressure chamber 201, opens the first release passage 207*a* so as to be able to communicate with the first pressure chamber 201. The inner portion of the valve seat member 207 forms a toric planar valve seat 207*b* on an end surface on a side of the protrusion into the first pressure chamber 201.

With respect to the valve seat 207*b*, the first pressure chamber 201 is opened and closed with respect to the return passage 291 by the valve movable portion 206*b* of the valve member 206 being coaxially separated and seated in accordance with a reciprocating displacement in the axial direction. More specifically, when the valve movable portion 206*b* is separated from the valve seat 207*b*, that is, separated from the valve seat 207*b* in the axial direction, the first pressure chamber 201 communicates with the first release passage 207*a* and brought in a valve open state in which the first pressure chamber 201 is opened to the return passage 291. Therefore, a direction in which the valve movable portion 206*b* is separated from the valve seat 207*b* is defined as a valve opening direction Do on an open side of the first pressure chamber 201. On the other hand, when the valve movable portion 206*b* is seated in the valve seat 207*b*, that is, comes in contact with the valve seat 207*b* in the axial direction, the first pressure chamber 201 is shut off from the first release passage 207*a* and brought in a valve close state where the first pressure chamber 201 is closed from the return passage 291. Therefore, the direction in which the valve movable portion 206*b* is seated in the valve seat 207*b* is defined as a valve closing direction Dc which is a closed side of the first pressure chamber 201.

The resilient member 208 is made of a metal wire material and formed in the shape of a compression coil spring. The resilient member 208 is accommodated in the third pressure chamber 203 and positioned coaxially with the second partition member 205. The resilient member 208 is interposed between a bottom portion of the third cylindrical portion 200*c* surrounding the third pressure chamber 203 and the second partition movable portion 206*d* mounted on the second partition member 205. The resilient member 208 is elastically deformed by compression between the third cylindrical portion 200*c* and the second partition movable portion 206*d*, to thereby generate a restoring force to urge the valve member 206 in the valve closing direction Dc. In this example, in the restoring force generated by the resilient member 208, in particular, the restoring force in the valve close state in which the valve movable portion 206*b* is seated on the valve seat 207*b* is defined as a set load F. The set load F can be set in advance by adjusting a bottom position of the third cylindrical portion 200*c*, which is regularly in contact with the resilient member 208, by, for example, metal pressing or the like.

The passage unit 21 is made of multiple resin materials or metal materials. The passage unit 21 is internally provided with first to third branch passages 211, 212, and 213 and second and third release passages 214 and 215.

The first branch passage 211 communicates between the fuel flow passage 290 and the first pressure chamber 201. The first branch passage 211 in an open state in which the first pressure chamber 201 is regularly opened to the fuel flow passage 290 allows a part of the fuel branched from the fuel flow passage 290 to flow into the first pressure chamber 201. As a result, the fuel flow passage 290 and the first pressure chamber 201 have substantially the same internal fuel pressure. The fuel flowing into the first pressure chamber 201 in this manner is released into the fuel tank 3 through the return passage 291 by the first release passage 207*a* in the valve open state communicating with the first pressure chamber 201 as described above.

The second branch passage 212 is provided so as to be openable and closable by the switching unit 22 between the fuel flow passage 290 and the second pressure chamber 202. The second branch passage 212 in an open state in which the second pressure chamber 202 is opened to the fuel flow passage 290 allows a part of the fuel branched from the fuel flow passage 290 to flow into the second pressure chamber 202. As a result, the fuel flow passage 290 and the second pressure chamber 202 have substantially the same internal fuel pressure.

The third branch passage 213 is provided so as to be openable and closable by the switching unit 22 between the fuel flow passage 290 and the third pressure chamber 203. The third branch passage 213 in an open state in which the third pressure chamber 203 is opened to the fuel flow passage 290 allows a part of the fuel branched from the fuel flow passage 290 to flow into the third pressure chamber 203. As a result, the fuel flow passage 290 and the third pressure chamber 203 have substantially the same internal fuel pressure.

The second release passage 214 is provided between the return passage 291 and the second pressure chamber 202 so as to be openable and closable by the switching unit 22. The second release passage 214 in an open state in which the second pressure chamber 202 is opened to the return passage 291 allows the fuel in the second pressure chamber 202 to release into the fuel tank 3 through the return passage 291. As a result, an internal pressure in the second pressure chamber 202 and an internal pressure of a space above the fuel in the fuel tank 3 are substantially equal to each other and can be simulated as an atmospheric pressure.

The third release passage 215 is provided between the return passage 291 and the third pressure chamber 203 so as to be openable and closable by the switching unit 22. The third release passage 215 in an open state in which the third pressure chamber 203 is opened to the return passage 291 allows the fuel in the third pressure chamber 203 to release into the fuel tank 3 through the return passage 291. As a result, an internal pressure in the third pressure chamber 203 and an internal pressure of a space above the fuel in the fuel tank 3 are substantially equal to each other and can be simulated as an atmospheric pressure.

The switching unit 22 is formed by combining first to third electromagnetic valves 221, 222, and 223 together. Each of the electromagnetic valves 221, 222, and 223 is electrically connected to the control circuit system 5 through the terminals 251*a* of the electrical connector 251.

The first electromagnetic valve 221 is a four-port direction switching valve, and is provided across intermediate portions of the second and third release passages 214 and 215. The first electromagnetic valve 221 switches an opening and closing state of the second pressure chamber 202 with respect to the return passage 291 and an opening and closing state of the third pressure chamber 203 with respect to the return passage 291 between a common open state and a mutually opposite open relationship by following an energization control by the control circuit system 5.

Figure 4:
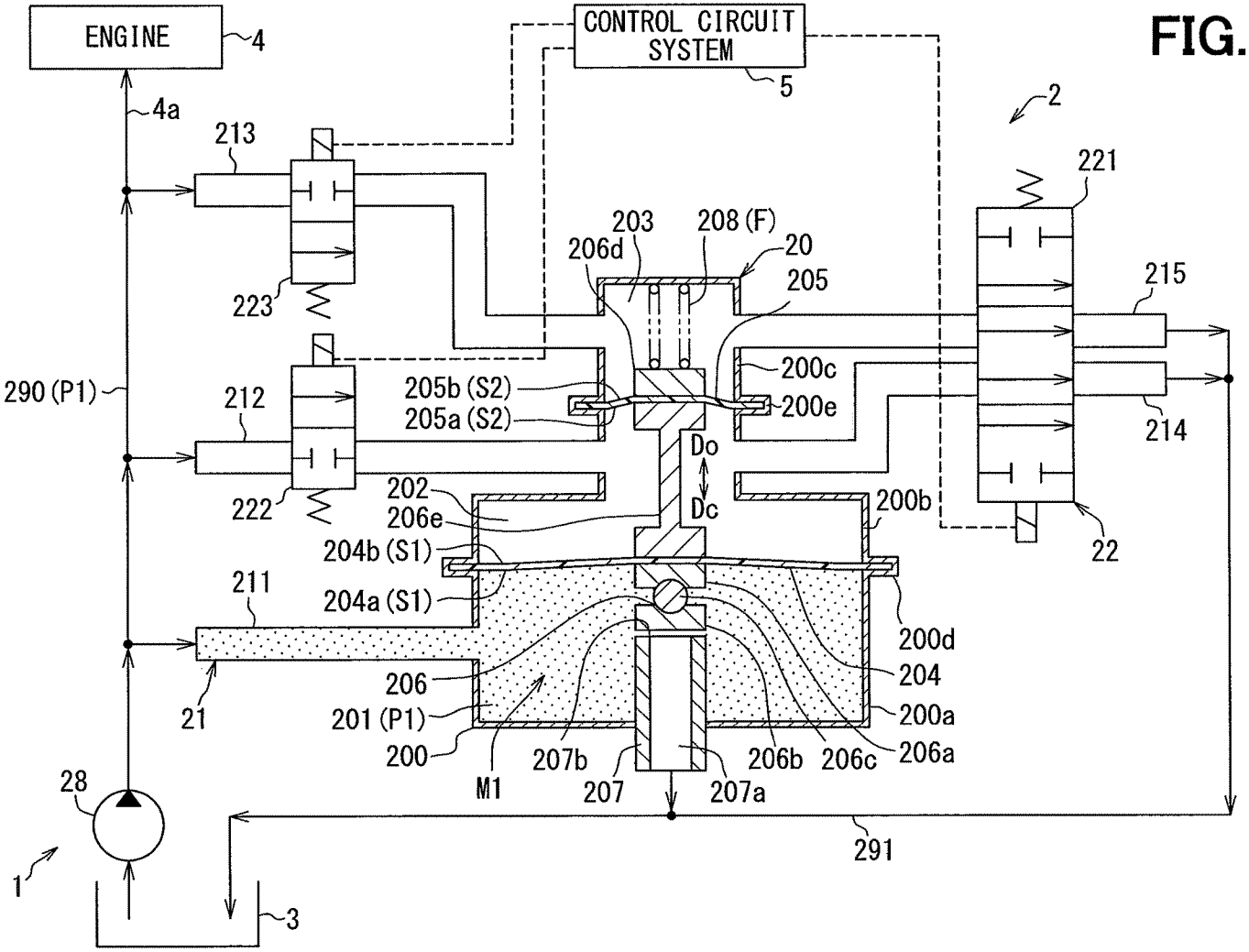
FIG. 4 is a schematic diagram showing an operation state of the pressure regulator according to at least one embodiment.

More specifically, as shown in a column of a first mode M1 in FIG. 3 and FIG. 4, the first electromagnetic valve 221 realizes the open state of the second pressure chamber 202 with respect to the return passage 291 and the open state of the third pressure chamber 203 with respect to the return passage 291 by a predetermined energization amount. On the other hand, as shown in a column of a second mode M2 in FIG. 3 and FIG. 5, the first electromagnetic valve 221 realizes the closed state of the second pressure chamber 202 with respect to the return passage 291 and the open state of the third pressure chamber 203 with respect to the return passage 291 by a change in the amount of energization. Further, as shown in a column of a third mode M3 in FIG. 3 and FIG. 6, the first electromagnetic valve 221 realizes the open state of the second pressure chamber 202 with respect to the return passage 291 and the closed state of the third pressure chamber 203 with respect to the return passage 291 by stopping the energization.

As shown in FIG. 2, the second electromagnetic valve 222 is a two-port type direction switching valve, and is provided at an intermediate portion of the second branch passage 212. The second electromagnetic valve 222 switches the opening and closing state of the second pressure chamber 202 with respect to the fuel flow passage 290 to an open-close relationship opposite to the opening and closing state with respect to the return passage 291 of the second pressure chamber 202 by the first electromagnetic valve 221 by following the energization control by the control circuit system 5.

Figure 5:
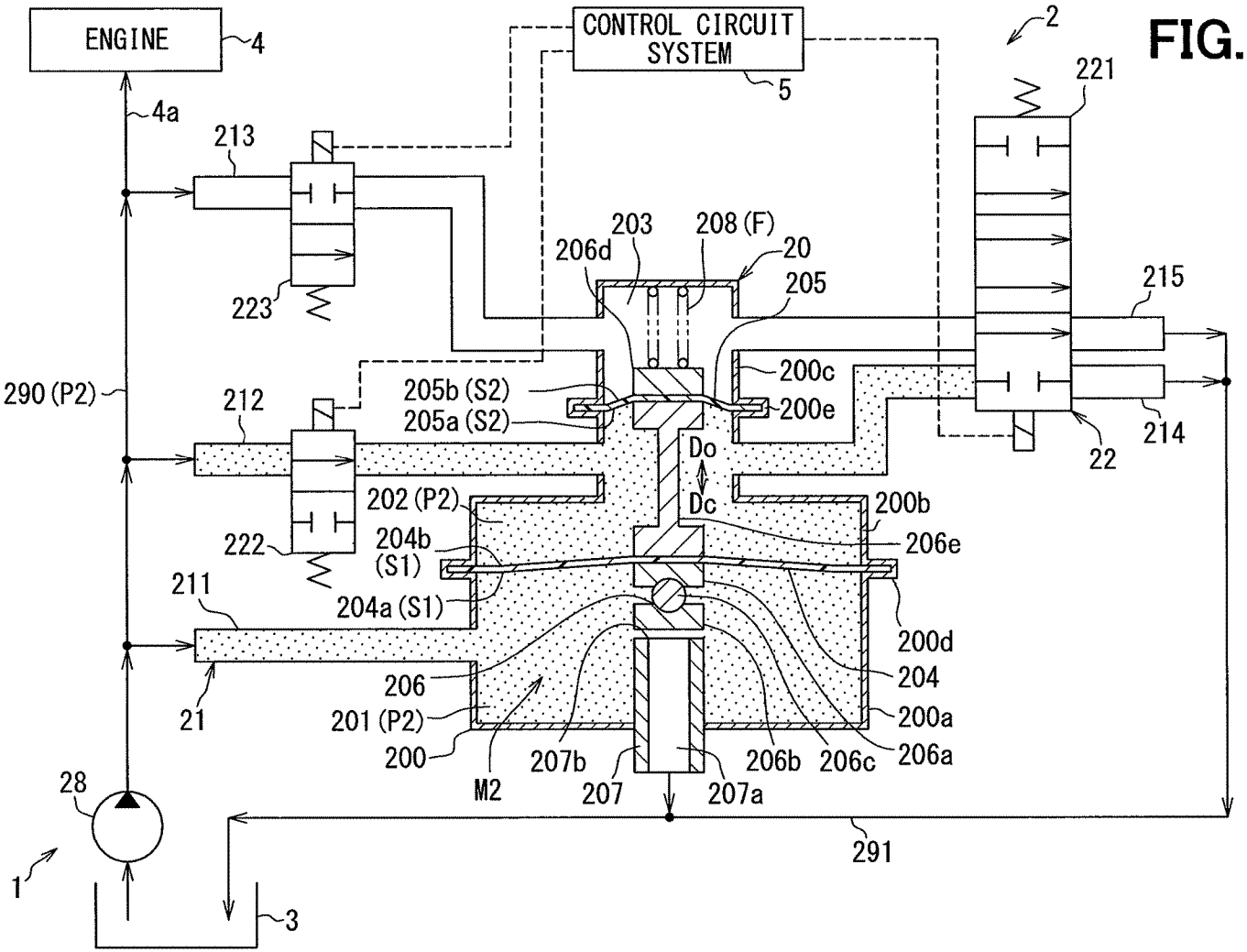
FIG. 5 is a schematic diagram showing an operation state of the pressure regulator according to at least one embodiment, which is different from that shown in FIG. 4.

Specifically, as shown in the column of the second mode M2 in FIG. 3 and FIG. 5, the second electromagnetic valve 222 realizes the open state in which the second pressure chamber 202 communicates with the fuel flow passage 290 by energization, contrary to the closed state of the second pressure chamber 202 with respect to the return passage 291. On the other hand, as shown in the columns of the first and third modes M1 and M3 in FIG. 3 and in FIGS. 4 and 6, the second electromagnetic valve 222 realizes the closed state in which the second pressure chamber 202 is shut off from the fuel flow passage 290 by stopping the energization, contrary to the open state of the second pressure chamber 202 with respect to the return passage 291.

As shown in FIG. 2, the third electromagnetic valve 223 is a two-port type direction switching valve, and is provided at an intermediate portion of the third branch passage 213. The third electromagnetic valve 223 switches the opening and closing state of the third pressure chamber 203 with respect to the fuel flow passage 290 to an open-close relationship opposite to the opening and closing state with respect to the return passage 291 of the third pressure chamber 203 by the first electromagnetic valve 221 by following the energization control by the control circuit system 5.

More specifically, as shown in the columns of the first and second modes M1 and M2 in FIG. 3 and in FIGS. 4 and 5, the third electromagnetic valve 223 realizes the closed state in which the third pressure chamber 203 is shut off from the fuel flow passage 290 by energization, contrary to the open state of the third pressure chamber 203 with respect to the return passage 291. On the other hand, as shown in the column of the third mode M3 in FIG. 3 and FIG. 6, the third electromagnetic valve 223 realizes the open state in which the third pressure chamber 203 communicates with the fuel flow passage 290 by stopping the energization, contrary to the closed state of the third pressure chamber 203 with respect to the return passage 291.

Now, when the viewpoint is changed, as shown in the column of the second mode M2 in FIG. 3 and FIG. 5, the third electromagnetic valve 223 realizes the closed state of the third pressure chamber 203 with respect to the fuel flow passage 290 by energization, contrary to the open state of the second pressure chamber 202 with respect to the fuel flow passage 290. On the other hand, as shown in the column of the third mode M3 in FIG. 3 and FIG. 6, the third electromagnetic valve 223 realizes the open state of the third pressure chamber 203 with respective to the fuel flow passage 290 by stopping the energization, contrary to the closed state of the second pressure chamber 202 with respect to the fuel flow passage 290. Further, as shown in the column of the first mode M1 in FIG. 3 and FIG. 4, the third electromagnetic valve 223 realizes the closed state of the third pressure chamber 203 with respect to the fuel flow passage 290 by energization as a common open-close relationship with the closed state of the second pressure chamber 202 with respect to the fuel flow passage 290.

As described above, in the switching unit 22, the opening and closing state of the second pressure chamber 202 with respect to the fuel flow passage 290 and the opening and closing state of the third pressure chamber 203 with respect to the fuel flow passage 290 are switched between the mutually opposite open-close relationship and the common closed state.

(Comprehensive Operation of Pressure Regulator)

Next, the comprehensive operation of the pressure regulator 2 will be described. In the following description, a fuel pressure in each of the modes M1, M2, and M3 means a gauge pressure (that is, a differential pressure) of the fuel pressure relative to an atmospheric pressure that can be simulated as a space pressure above the fuel in the fuel tank 3. In the following description, the restoring force of the resilient member 208 is approximated as the set load F regardless of the displacement position of the valve member 206.

First, in the first mode M1 shown in FIGS. 3 and 4, the switching unit 22 realizes the closed state of the second pressure chamber 202 with respect to the fuel flow passage 290 and the open state of the second pressure chamber 202 with respect to the return passage 291. At the same time, in the first mode M1, the switching unit 22 realizes the closed state of the third pressure chamber 203 with respect to the fuel flow passage 290 and the open state of the third pressure chamber 203 with respect to the return passage 291. As a result, a fuel pressure P1 of the fuel flow passage 290 becomes substantially equal to the fuel pressure of the first pressure chamber 201 in the valve open state. Therefore, the fuel pressure P1 of the fuel flow passage 290 is expressed by the following Expression 2 using the set load F and the first pressure receiving area S1.

$$P1=F/S1 \quad \text{(Expression 2)}$$

Next, in the second mode M2 shown in FIGS. 3 and 5, the switching unit 22 realizes the open state of the second pressure chamber 202 with respect to the fuel flow passage 290 and the closed state of the second pressure chamber 202 with respect to the return passage 291. At the same time, in the second mode M2, the switching unit 22 realizes the closed state of the third pressure chamber 203 with respect to the fuel flow passage 290 and the open state of the third pressure chamber 203 with respect to the return passage 291. As a result, the fuel pressure P2 of the fuel flow passage 290 is substantially equal to the fuel pressure of the second pressure chamber 202 as well as the fuel pressure of the first pressure chamber 201 in the valve open state. Therefore, the fuel pressure P2 of the fuel flow passage 290 is expressed by the following Expression 3 using the set load F, the first pressure receiving area S1, and an area comparison coefficient A.

$$P2=A\cdot F/S1 \quad \text{(Expression 3)}$$

Figure 6:
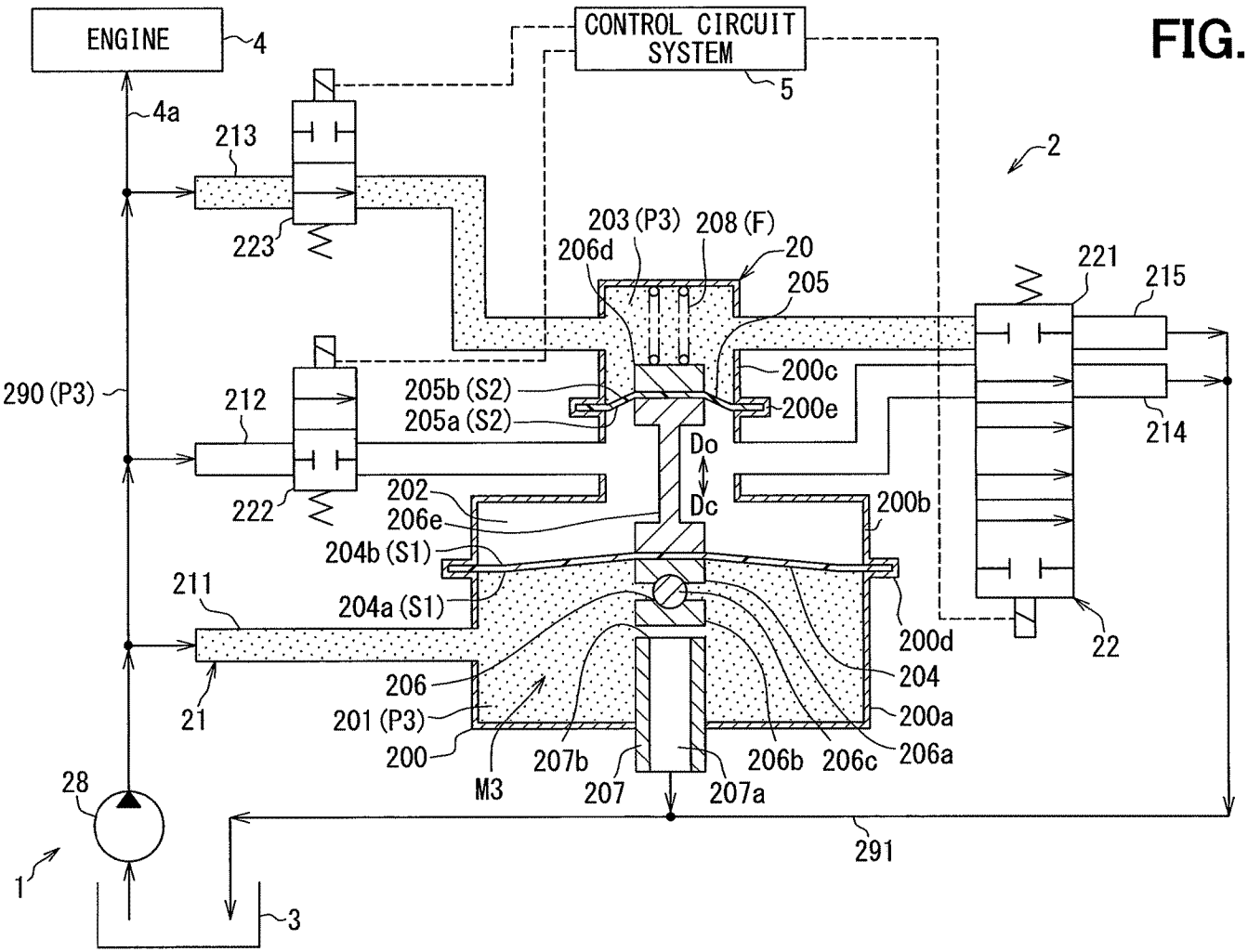
FIG. 6 is a schematic diagram showing an operation state of the pressure regulator according to at least one embodiment, which is different from that shown in FIGS. 4 and 5.

Next, in the third mode M3 shown in FIGS. 3 and 6, the switching unit 22 realizes the closed state of the second pressure chamber 202 with respect to the fuel flow passage 290 and the open state of the second pressure chamber 202 with respect to the return passage 291. At the same time, in the third mode M3, the switching unit 22 realizes the open state of the third pressure chamber 203 with respect to the fuel flow passage 290 and the closed state of the third pressure chamber 203 with respect to the return passage 291. As a result, the fuel pressure P3 of the fuel flow passage 290 becomes substantially equal to the fuel pressure of the third pressure chamber 203 as well as the fuel pressure of the first pressure chamber 201 in the valve open state. Therefore, the fuel pressure P3 of the fuel flow passage 290 is expressed by the following Expression 4 using the set load F, the first pressure receiving area S1, and the area comparison coefficient A.

$$P3=A\cdot F/\{S1\cdot(A-1)\} \quad \text{(Expression 4)}$$

From Expressions 2, 3, and 4 expressed as described above, in the present embodiment, the fuel pressures P1, P2, and P3 of the fuel flow passage 290 in the modes M1, M2, and M3 satisfy the following Expression 6 in a range in which the area comparison coefficient A satisfies the following Expression 5. Therefore, the third mode M3 in which the fuel pressure in the fuel flow passage 290 becomes the highest fuel pressure P3 is executed, for example, at the time of restarting the internal combustion engine in which there is a need to prevent a vapor conversion of the fuel in the high temperature state. Accordingly, in particular, in the present embodiment in which the energization of all the electromagnetic valves 221, 222, and 223 is stopped in the third mode M3, the switching unit 22 becomes in the third mode M3 by stopping the energization not only during a restart but also during the stop state of the internal combustion engine before the restart. Thus, the vaporization suppression effect of the fuel is improved. On the other hand, the first mode M1 in which the fuel pressure in the fuel flow passage 290 becomes the lowest fuel pressure P1 is executed, for example, at the time of steady operation of an internal combustion engine in which there is a need to reduce consumption of the fuel and improve a fuel efficiency. Further, the second mode M2 in which the fuel pressure of the fuel flow passage 290 becomes the intermediate fuel pressure P2 is executed, for example, during a transition period from the third mode M3 of the highest pressure to the first mode M1 of the lowest pressure, in which there is a need to reduce a sudden air-fuel consumption variation of the internal combustion engine.

$$1<A<2 \quad \text{(Expression 5)}$$

$$P1<P2<P3 \quad \text{(Expression 6)}$$

(Operational Effects)

The operational effects of the embodiment described so far will be described below.

According to the embodiment, the adjacent first and second pressure chambers 201 and 202 are partitioned from each other by the first partition member 204, and the adjacent second and third pressure chambers 202 and 203 are separated by the second partition member 205. In such a partition structure, when the switching unit 22 switches the opening and closing state of each of the second and third pressure chambers 202 and 203 with respect to the fuel flow passage 290, the valve member 206 for opening or closing the first pressure chamber 201 with respect to the return passage 291 moves with the first and second partition members 204 and 205, to thereby adjust the fuel pressure in the fuel flow passage 290.

In this example, in the second pressure chamber 202 according to the embodiment, in the first to third modes M1 to M3, the switching unit 22 switches the opening and closing state with respect to the fuel flow passage 290 and the opening and closing state with respect to the return passage 291 to the mutually opposite open-close relationship. Thus, in the second pressure chamber 202, a situation in which an extra work is forced on the fuel pump 28 can be avoided by switching to the closed state with respect to the passage 291, while a change from the fuel pressure before switching can quickly occur at each switching of the opening and closing state with respect to the passages 290 and 291. In the second pressure chamber 202 accommodating the valve member 206 according to the embodiment, in particular, since the fuel is circulated every time the opening and closing state with respect to the passages 290 and 291 are switched, there is also an effect that the reliability of the accommodating element 206 can be prevented from being lowered by the fuel that has stagnated and deteriorated.

Similarly, in the third pressure chamber 203 according to the embodiment, in the first to third modes M1 to M3, the switching unit 22 switches the opening and closing state with respect to the fuel flow passage 290 and the opening and closing state with respect to the return passage 291 to the open-close relationship opposite to each other. Therefore, even in the third pressure chamber 203, a situation in which the fuel pump 28 is forced to perform the extra work can be avoided by switching to the closed state with respect to the passage 291, while a change from the fuel pressure before the switching can quickly occur with each switching of the opening and closing state with respect to the passages 290 and 291. In the third pressure chamber 203 accommodating the resilient member 208 and the valve member 206 according to the embodiment, in particular, since the fuel flows every time the opening and closing state of the passages 290 and 291 is switched, there is also an effect that the reliability of the accommodation elements 208 and 206 can be prevented from being lowered by the fuel that has stayed and deteriorated.

Further, according to the switching unit 22 of the embodiment, the opening and closing state of the second pressure chamber 202 with respect to the fuel flow passage 290 is not only switched to an open-close relationship opposite to the opening and closing state of the second pressure chamber 202 with respect to the return passage 291. Specifically, in the second and third modes M2 and M3, the opening and closing state of the second pressure chamber 202 with respect to the fuel flow passage 290 is switched to the open-close relationship opposite to the opening and closing state of the third pressure chamber 203 with respect to the fuel flow passage 290. As a result, the opening and closing state of the third pressure chamber 203 with respect to the return passage 291 is not only switched to the opposite open-close relationship to the opening and closing state of the third pressure chamber 203 with respect to the fuel flow passage 290. Specifically, in the second and third modes M2 and M3, the opening and closing state of the third pressure chamber 203 with respect to the return passage 291 is switched to the open-close relationship opposite to the opening and closing state of the second pressure chamber 202 with respect to the return passage 291. Therefore, according to the switching of the opening and closing of the second and third pressure chambers 202 and 203, a change from the fuel pressure before the switching can occur quickly every time the fuel pressure adjusted in at least two stages in the fuel flow passage 290 is adjusted.

Further, according to the switching unit 22 of the embodiment, the opening and closing state of each of the second and third pressure chambers 202 and 203 with respect to the fuel flow passage 290 are switched between the open-close relationships opposite to each other and the common closed states in the first to third modes M1 to M3. As a result, the opening and closing states of the second and third pressure chambers 202 and 203 with respect to the return passage 291 are switched between the open-close relationships opposite to each other and the common opening states in the first to third modes M1 to M3. Therefore, according to the switching of the opening and closing of the second and third pressure chambers 202 and 203, a change from the fuel pressure before the switching can occur quickly every time the fuel pressure adjusted in three stages in the fuel flow passage 290 is adjusted.

Therefore, according to the embodiment capable of exhibiting the effects described above, it is possible to improve the responsiveness and the pressure regulation accuracy together with an improvement in the fuel efficiency.

In addition, the resilient member 208 according to the embodiment urges the valve member 206 movable with the first and second partition members 204 and 205 in the valve closing direction Dc serving as the closed side of the first pressure chamber 201. In such an urging structure, the first partition member 204, which is a diaphragm, provides the first pressure receiving area S1 common to the first and second pressure chambers 201 and 202 to the both surfaces 204*a* and 204*b*. At the same time, the second partition member 205, which is a diaphragm, provides a second pressure receiving area S2, which is common to the second and third pressure chambers 202 and 203 and smaller than the first pressure receiving area S1, to the both surfaces 205*a* and 205*b*. Therefore, with the provision of the first and second pressure receiving areas S1 and S2 to the first and second partition members 204 and 205, respectively, the fuel pressure in the fuel flow passage 290 can be reliably adjusted to a range of a positive pressure, and therefore, the reliability of the pressure regulator 2 can be enhanced.

(Second Embodiment)

Figure 7:
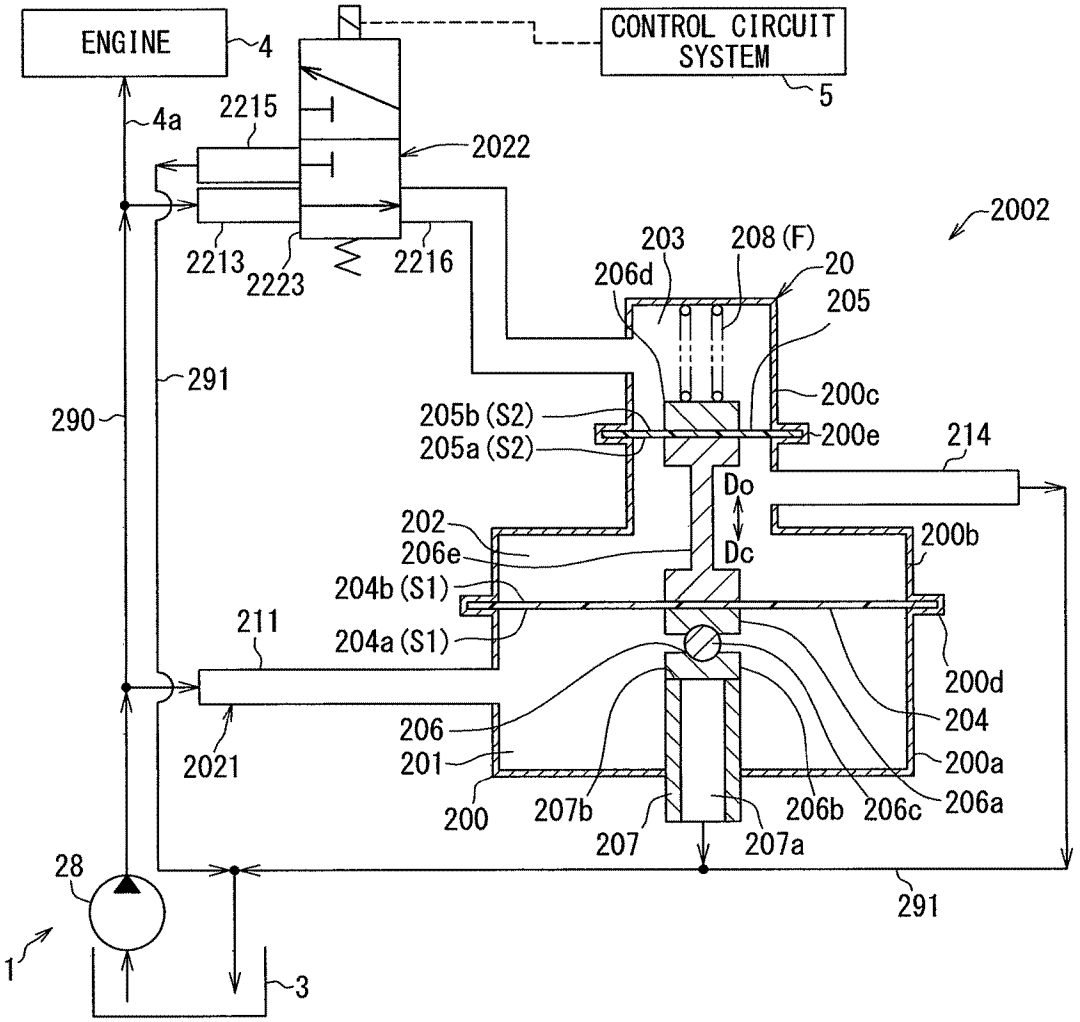
FIG. 7 is a detailed configuration diagram showing a pressure regulator according to at least one embodiment.

As shown in FIG. 7, an embodiment of the present disclosure is a modification of the embodiment.

A passage unit 2021 of a pressure regulator 2002 according to the embodiment does not provide a second branch passage 212. With the above configuration, a third release passage 2215 of the passage unit 2021 shares a common portion 2216 closer to a third pressure chamber 203 than the switching unit 2022, which will be described later in detail, with a third branch passage 2213. The passage unit 2021 is the same as that described in the embodiment except for the above configurations.

The switching unit 2022 of the pressure regulator 2002 according to the embodiment includes only a third electromagnetic valve 2223, and the third electromagnetic valve 2223 is electrically connected to a control circuit system 5 through terminals 251*a* of an electrical connector 251. The third electromagnetic valve 2223 is a three-port type direction switching valve, and is provided at a position in the middle of the third branch passage 2213 and the third release passage 2215 in which the common portion 2216 is shared on the side of the third pressure chamber 203. The third electromagnetic valve 2223 switches the opening and closing state of the third pressure chamber 203 with respect to the fuel flow passage 290 and the opening and closing state of the third pressure chamber 203 with respect to the return passage 291 to the open-close relationships opposite to each other by following the energization control by the control circuit system 5.

Figure 9:
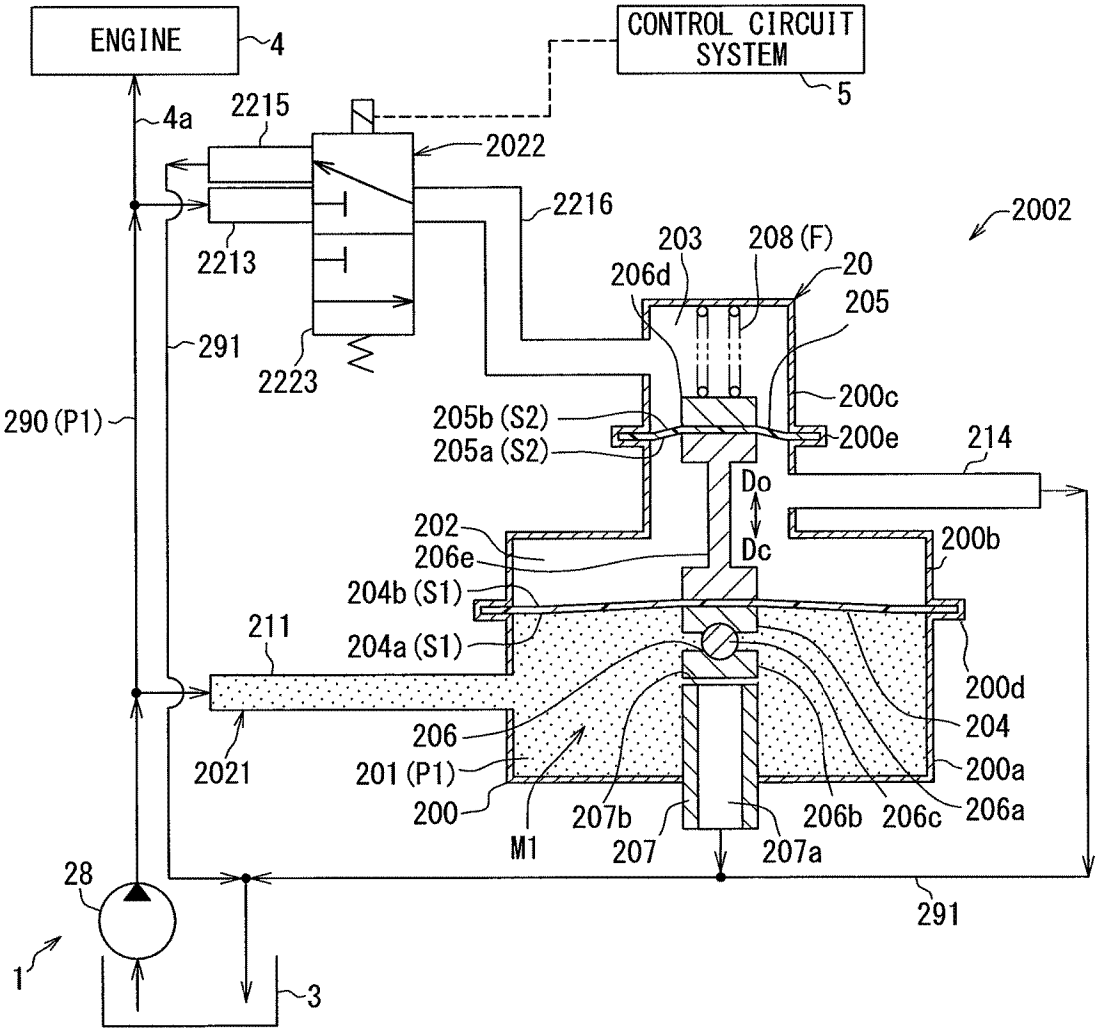
FIG. 9 is a schematic diagram showing an operation state of the pressure regulator according to at least one embodiment.

Specifically, as shown in a column of a first mode M1 in FIG. 8 and FIG. 9, the third electromagnetic valve 2223 realizes a closed state in which the third pressure chamber 203 is shut off from the fuel flow passage 290, and conversely, an open state in which the third pressure chamber 203 communicates with the return passage 291 by energization. On the other hand, as shown in a column of a second mode M2 in FIG. 9 and FIG. 10, the third electromagnetic valve 2223 realizes an open state in which the third pressure chamber 203 communicates with the fuel flow passage 290, and a closed state in which the third pressure chamber 203 is shut off from the return passage 291 by stopping the energization.

Hereinafter, the overall operation of the pressure regulator 2002 according to the embodiment described above will be described. Also in the embodiment, since the second pressure receiving area S2 is set to a value smaller than the first pressure receiving area S1 in advance, the area comparison coefficient A represented by the Expression 1 described in the embodiment becomes a value larger than 1.

First, in the first mode M1 shown in FIGS. 8 and 9, the switching unit 2022 realizes the closed state of the third pressure chamber 203 with respect to the fuel flow passage 290 and the open state of the third pressure chamber 203 with respect to the return passage 291. As a result, a fuel pressure P1 of the fuel flow passage 290 becomes substantially equal to the fuel pressure of the first pressure chamber 201 in the valve open state. Therefore, the fuel pressure P1 of the fuel flow passage 290 is expressed by the following Expression 7 using the set load F and the first pressure receiving area S1.

$$P1=F/S1 \quad \text{(Expression 7)}$$

Figure 10:
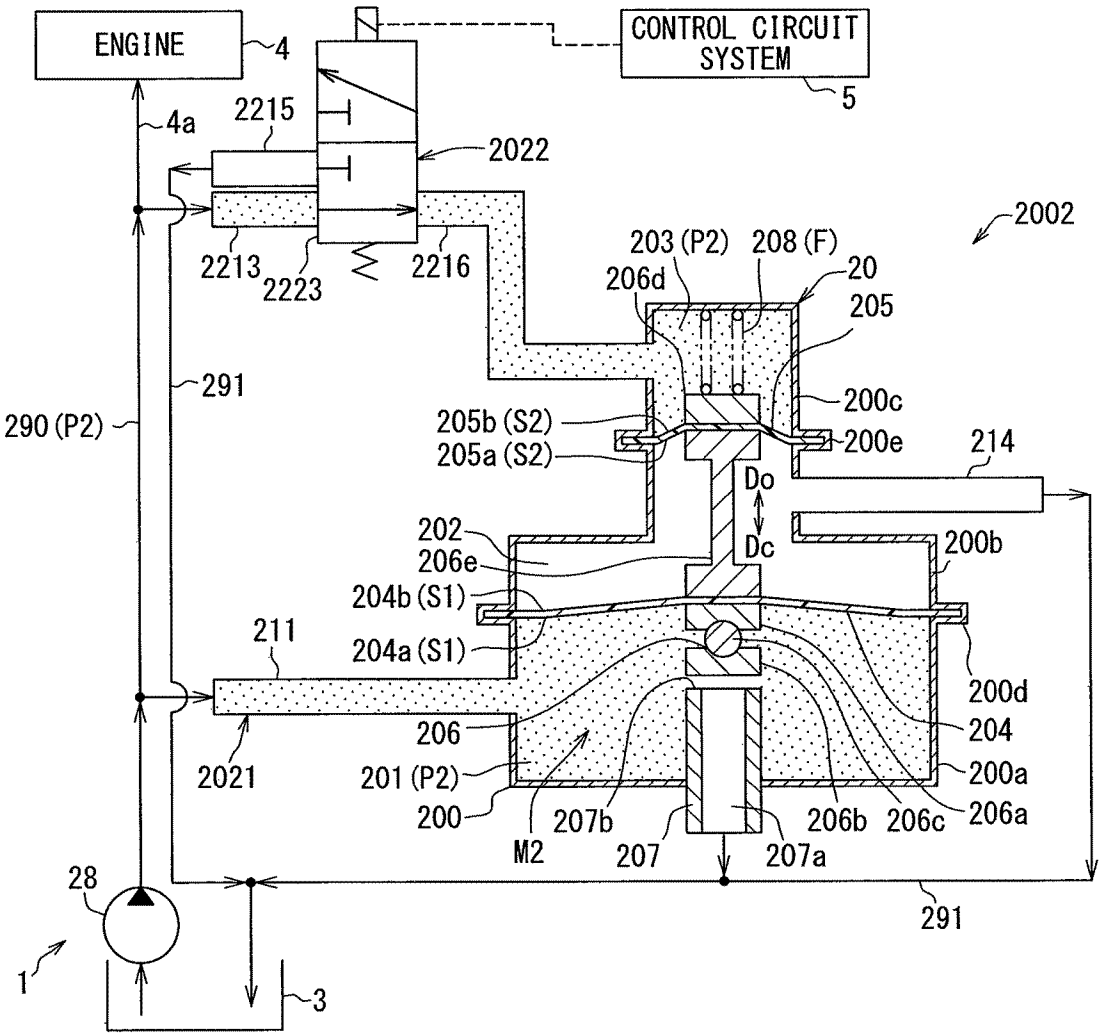
FIG. 10 is a schematic diagram showing another operation state of the pressure regulator according to at least one embodiment, which is different from that of FIG. 9.

Next, in the second mode M2 shown in FIGS. 8 and 10, the switching unit 2022 realizes the open state of the third pressure chamber 203 with respect to the fuel flow passage 290 and the closed state of the third pressure chamber 203 with respect to the return passage 291. As a result, the fuel pressure P2 of the fuel flow passage 290 becomes substantially equal to the fuel pressure of the third pressure chamber 203 as well as the fuel pressure of the first pressure chamber 201 in the valve open state. Therefore, the fuel pressure P2 of the fuel flow passage 290 is expressed by the following Expression 4 using the set load F, the first pressure receiving area S1, and the area comparison coefficient A.

$$P2=A\cdot F/\{S1\cdot(A-1)\} \quad \text{(Expression 8)}$$

In the embodiment, from Expressions 7 and 8 as described above, the fuel pressures P1 and P2 of the fuel flow passages 290 in each mode M1 and M2 satisfy the following Expression 9. Therefore, the second mode M2 in which the fuel pressure in the fuel flow passage 290 becomes the fuel pressure P2 on the high-pressure side is executed, for example, at the time of restarting the internal combustion engine in which there is a need to reduce the vaporization of the fuel in the high temperature state. Therefore, in particular, in the embodiment in which the energization to the third electromagnetic valve 2223 is stopped in the second mode M2, the effect of reducing the vaporization of the fuel is enhanced by setting the switching unit 2022 to the second mode M2 by stopping the energization not only at the time of restart but also in the stopped state of the internal combustion engine before the restart. On the other hand, the first mode M1 in which the fuel pressure in the fuel flow passage 290 becomes the fuel pressure P1 on the low-pressure side is executed, for example, at the time of steady operation of the internal combustion engine in which there is a need to reduce the consumption of fuel and improve the fuel efficiency.

$$P1<P2 \quad \text{(Expression 9)}$$

Also in the embodiment described so far, the adjacent first and second pressure chambers 201 and 202 are partitioned from each other by the first partition member 204, and the adjacent second and third pressure chambers 202 and 203 are partitioned from each other by the second partition member 205. In this partition structure, when the switching unit 2022 switches the opening and closing state of the third pressure chamber 203 with respect to the fuel flow passage 290, the valve member 206 that opens or closes the first pressure chamber 201 with respect to the return passage 291 cooperates with the first and second partition members 204 and 205 to adjust the fuel pressure in the fuel flow passage 290.

Here, in the third pressure chamber 203 of the embodiment, the switching unit 2022 switches the opening and closing state with respect to the fuel flow passage 290 and the opening and closing state with respect to the return passage 291 to the mutually opposite open-close relationship. Thus, in the third pressure chamber 203, a situation in which an extra work is forced on the fuel pump 28 can be avoided by switching to the closed state with respect to the passage 291, while a change from the fuel pressure before switching can quickly occur at each switching of the opening and closing state with respect to the passages 290 and 291. In this case, in particular, if only the third pressure chamber 203 is switched to be open or closed by such a switching unit 2022, a change from the fuel pressure before the switching can occur quickly for each adjustment of the fuel pressure adjusted in two stages in the passage 290.

Therefore, according to the embodiment capable of achieving the above-mentioned effects, it is possible to improve the responsiveness and the pressure regulation accuracy together with the improvement in the fuel efficiency.

In addition, also in the embodiment, the resilient member 208 urges the valve member 206 in the valve closing direction Dc. Further, even in the embodiment, the first and second partition members 204 and 205, which are diaphragms, provide the first and second pressure receiving areas S1 and S2 common to the first and second pressure chambers 201 and 202 in the urging structure, and the second pressure receiving area S2 is smaller than the first pressure receiving area S1. Therefore, with the provision of the first and second pressure receiving areas S1 and S2 to the first and second partition members 204 and 205, respectively, the fuel pressure in the fuel flow passage 290 can be reliably adjusted to a range of a positive pressure, and therefore, the reliability of the pressure regulator 2002 can be enhanced.

(Third Embodiment)

Figure 11:
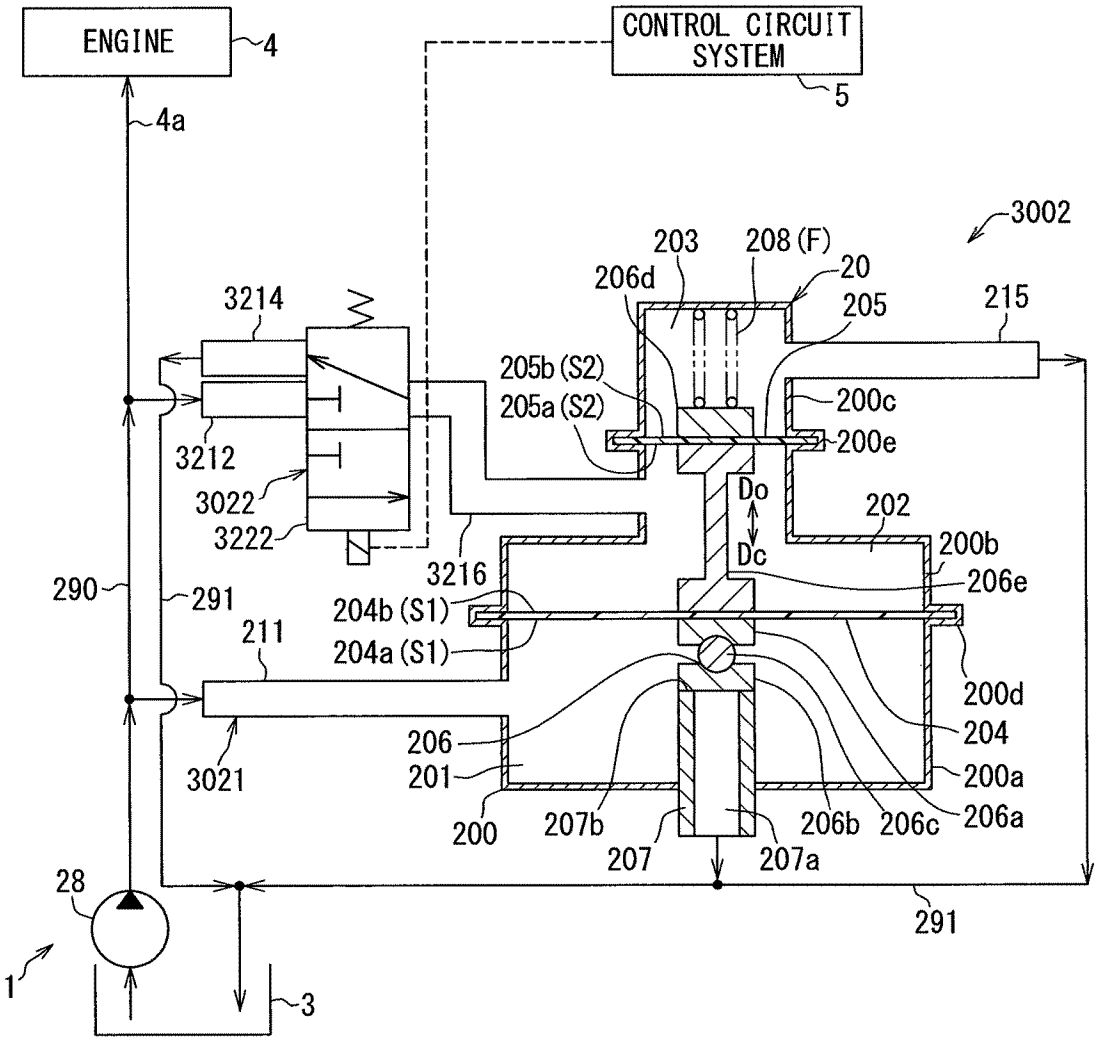
FIG. 11 is a detailed configuration diagram showing a pressure regulator according to at least one embodiment.

As shown in FIG. 11, a third embodiment of the present disclosure is a modification of the embodiment.

A passage unit 3021 of a pressure regulator 3002 according to the third embodiment does not provide a third branch passage 213. In addition, with the above configuration, a second release passage 3214 of the passage unit 3021 shares a common portion 3216, which is closer to a second pressure chamber 202 than a switching unit 3022, which will be described later in detail, with a second branch passage 3212. The passage unit 3021 is the same as that described in the embodiment except for the above configurations.

The switching unit 3022 of the pressure regulator 3002 according to the third embodiment includes only a second electromagnetic valve 3222, and the second electromagnetic valve 3222 is electrically connected to a control circuit system 5 through terminals 251*a* of an electrical connector 251. The second electromagnetic valve 3222 is a three-port type direction switching valve, and is provided at a position in the middle of a second branch passage 3212 and a second release passage 3214 in which the common portion 3216 is shared on the second pressure chamber 202 side. The second electromagnetic valve 3222 switches the opening and closing state of the second pressure chamber 202 with respect to the fuel flow passage 290 and the opening and closing state of the second pressure chamber 202 with respect to the return passage 291 to the open-close relationships opposite to each other by following the energization control by the control circuit system 5.

Figure 13:
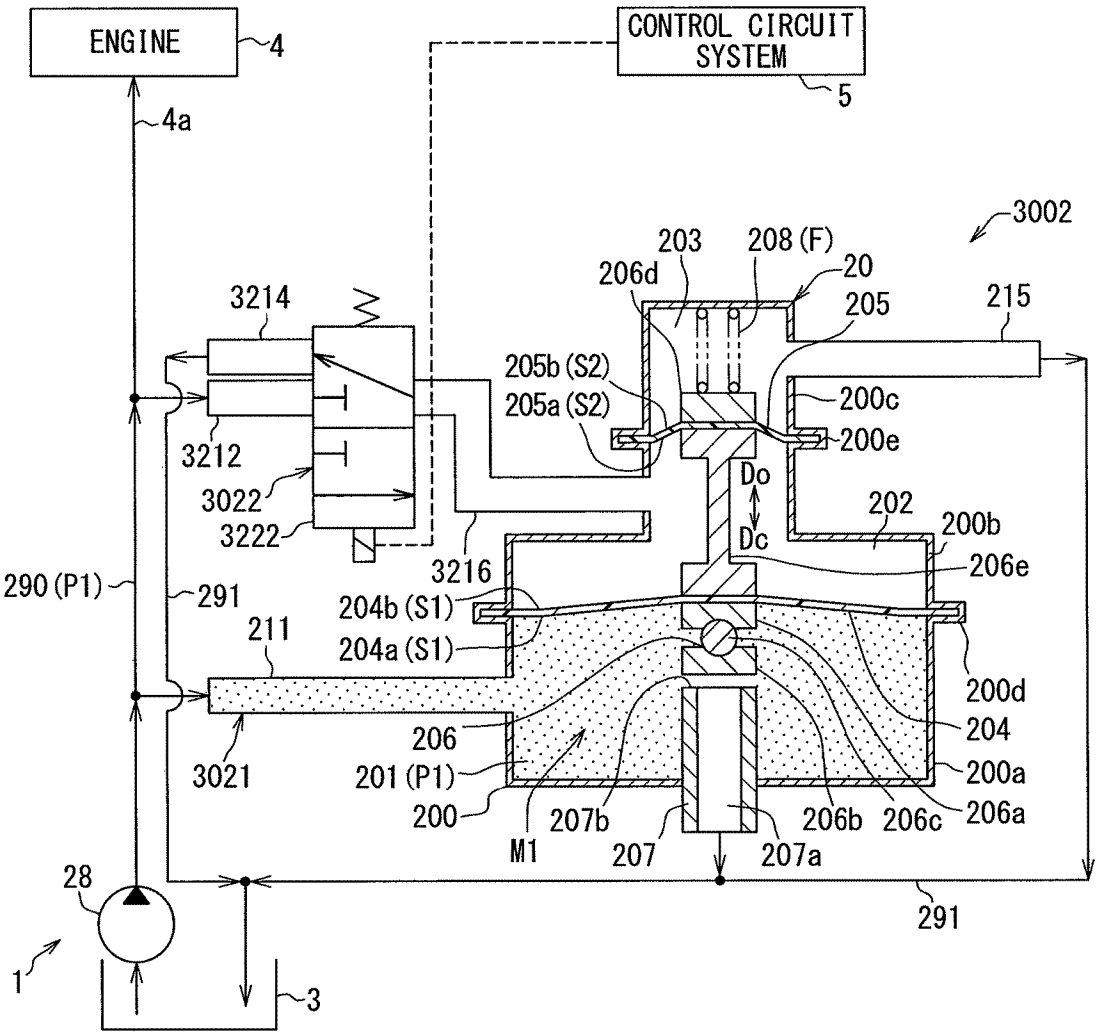
FIG. 13 is a schematic diagram showing an operation state of the pressure regulator according to at least one embodiment.

Specifically, as shown in a column of a first mode M1 in FIG. 12 and FIG. 13, the second electromagnetic valve 3222 realizes a closed state in which the second pressure chamber 202 is shut off from the fuel flow passage 290, and conversely, an open state in which the second pressure chamber 202 communicates with the return passage 291 by stopping the energization. On the other hand, as shown in a column of a second mode M2 in FIG. 12 and FIG. 14, the second electromagnetic valve 3222 realizes an open state in which the second pressure chamber 202 communicates with the fuel flow passage 290, and a closed state in which the second pressure chamber 202 is shut off from the return passage 291 by energization.

Hereinafter, the overall operation of the pressure regulator 3002 according to the third embodiment will be described. Also in the third embodiment, since the second pressure receiving area S2 is set to a value smaller than the first pressure receiving area S1 in advance, the area comparison coefficient A represented by Expression 1 described in the embodiment becomes a value larger than 1.

First, in the first mode M1 shown in FIGS. 12 and 13, the switching unit 3022 realizes the closed state of the second pressure chamber 202 with respect to the fuel flow passage 290 and the open state of the second pressure chamber 202 with respect to the return passage 291. As a result, a fuel pressure P1 of the fuel flow passage 290 becomes substantially equal to the fuel pressure of the first pressure chamber 201 in the valve open state. Therefore, a fuel pressure P1 of the fuel flow passage 290 is expressed by the following Expression 10 using the set load F and the first pressure receiving area S1.

$$P1=F/S1 \quad \text{(Expression 10)}$$

Figure 14:
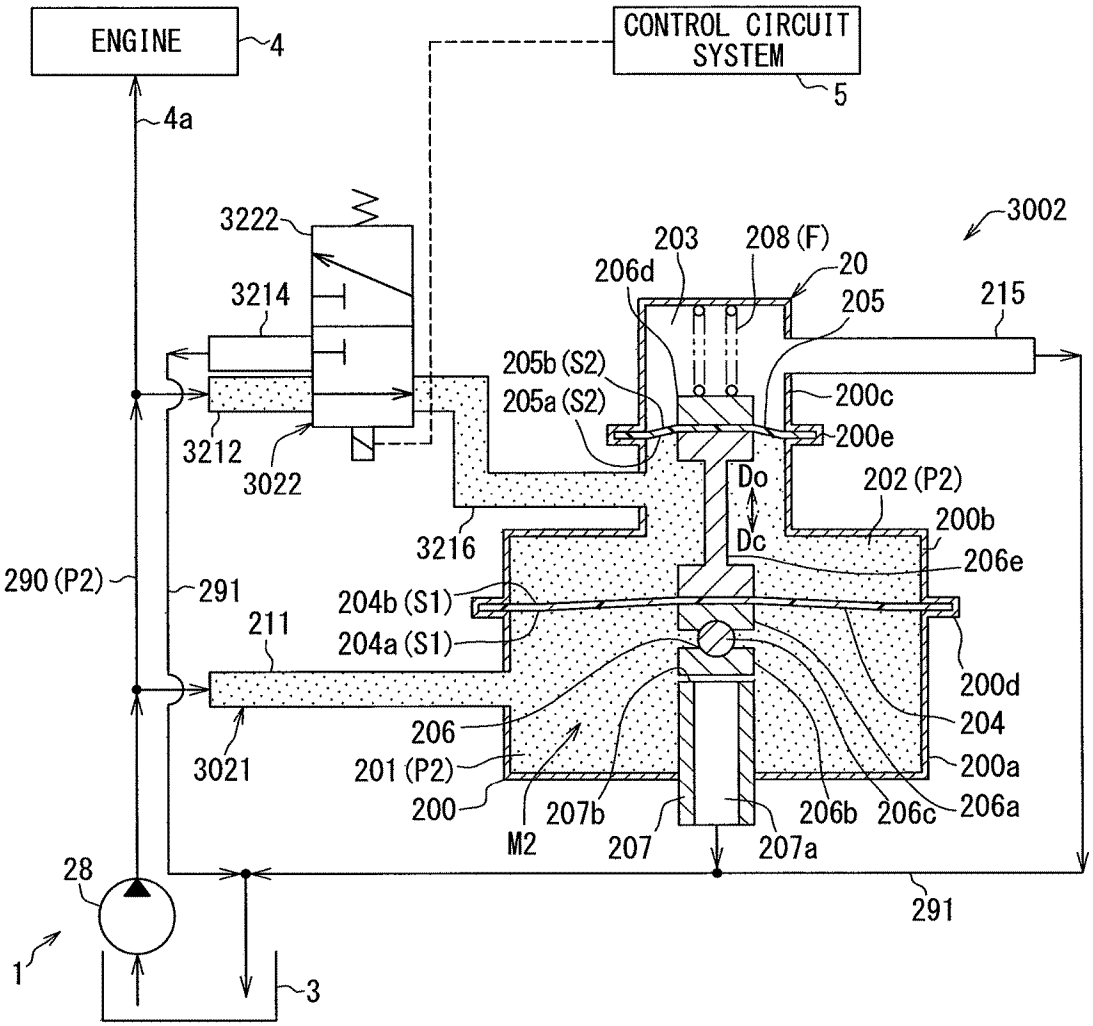
FIG. 14 is a schematic diagram showing an operation state of the pressure regulator according to at least one embodiment, which is different from that shown in FIG. 13.

Next, in the second mode M2 shown in FIGS. 12 and 14, the switching unit 3022 realizes the open state of the second pressure chamber 202 with respect to the fuel flow passage 290 and the closed state of the second pressure chamber 202 with respect to the return passage 291. As a result, the fuel pressure P2 of the fuel flow passage 290 becomes substantially equal to the fuel pressure of the second pressure chamber 202 as well as the fuel pressure of the first pressure chamber 201 in the valve open state. Therefore, the fuel pressure P2 of the fuel flow passage 290 is expressed by the following Expression 11 using the set load F, the first pressure receiving area S1, and the area comparison coefficient A.

$$P2=A\cdot F/S1 \quad \text{(Expression 11)}$$

In the third embodiment from the Expressions 10 and 11 expressed as described above, the fuel pressures P1 and P2 of the fuel flow passage 290 in the modes M1 and M2 satisfy the following Expression 12. Therefore, the second mode M2 in which the fuel pressure in the fuel flow passage 290 becomes the fuel pressure P2 on the high-pressure side is executed, for example, at the time of restarting the internal combustion engine in which there is a need to reduce the vaporization of the fuel in the high temperature state. On the other hand, the first mode M1 in which the fuel pressure in the fuel flow passage 290 becomes the fuel pressure P1 on the low-pressure side is executed, for example, at the time of steady operation of the internal combustion engine in which there is a need to reduce the consumption of fuel and improve the fuel efficiency.

$$P1<P2 \quad \text{(Expression 12)}$$

Also in the third embodiment described so far, the adjacent first and second pressure chambers 201 and 202 are partitioned from each other by the first partition member 204, and the adjacent second and third pressure chambers 202 and 203 are partitioned from each other by the second partition member 205. In the above partition structure, when the switching unit 3022 switches the opening and closing state of the second pressure chamber 202 with respect to the fuel flow passage 290, the valve member 206 that opens or closes the first pressure chamber 201 with respect to the return passage 291 moves with the first and second partition members 204 and 205 to adjust the fuel pressure in the fuel flow passage 290.

In this situation, in the third embodiment, the switching unit 3022 switches the opening and closing state of the second pressure chamber 202 with respect to the fuel flow passage 290 and the opening and closing state of the second pressure chamber 202 with respect to the return passage 291 to the open-close relationships opposite to each other. Thus, in the second pressure chamber 202, a situation in which an extra work is forced on the fuel pump 28 can be avoided by switching to the closed state with respect to the passage 291, while a change from the fuel pressure before switching can quickly occur at each switching of the opening and closing state with respect to the passages 290 and 291. In this example, in particular, if only the second pressure chamber 202 is switched to be open and closed by such a switching unit 3022, a change from the fuel pressure before the switching can occur quickly for each adjustment of the fuel pressure adjusted in two stages in the passage 290.

Therefore, also according to the third embodiment capable of achieving the above-mentioned effects, it is possible to improve the responsiveness and the pressure regulation accuracy together with the improvement in the fuel efficiency.

In addition, also in the third embodiment, the resilient member 208 urges the valve member 206 in the valve closing direction Dc. Further, in the third embodiment, the first and second partition members 204 and 205, which are the diaphragms, provide the first and second pressure receiving areas S1 and S2 common to the first and second pressure chambers 201 and 202 in the urging structure, and the second pressure receiving area S2 is smaller than the first pressure receiving area S1. Therefore, with the provision of the first and second pressure receiving areas S1 and S2 to the first and second partition members 204 and 205, respectively, the fuel pressure in the fuel flow passage 290 can be reliably adjusted to a range of a positive pressure, and therefore, the reliability of the pressure regulator 3002 can be enhanced.

(Fourth Embodiment)

Figure 15:
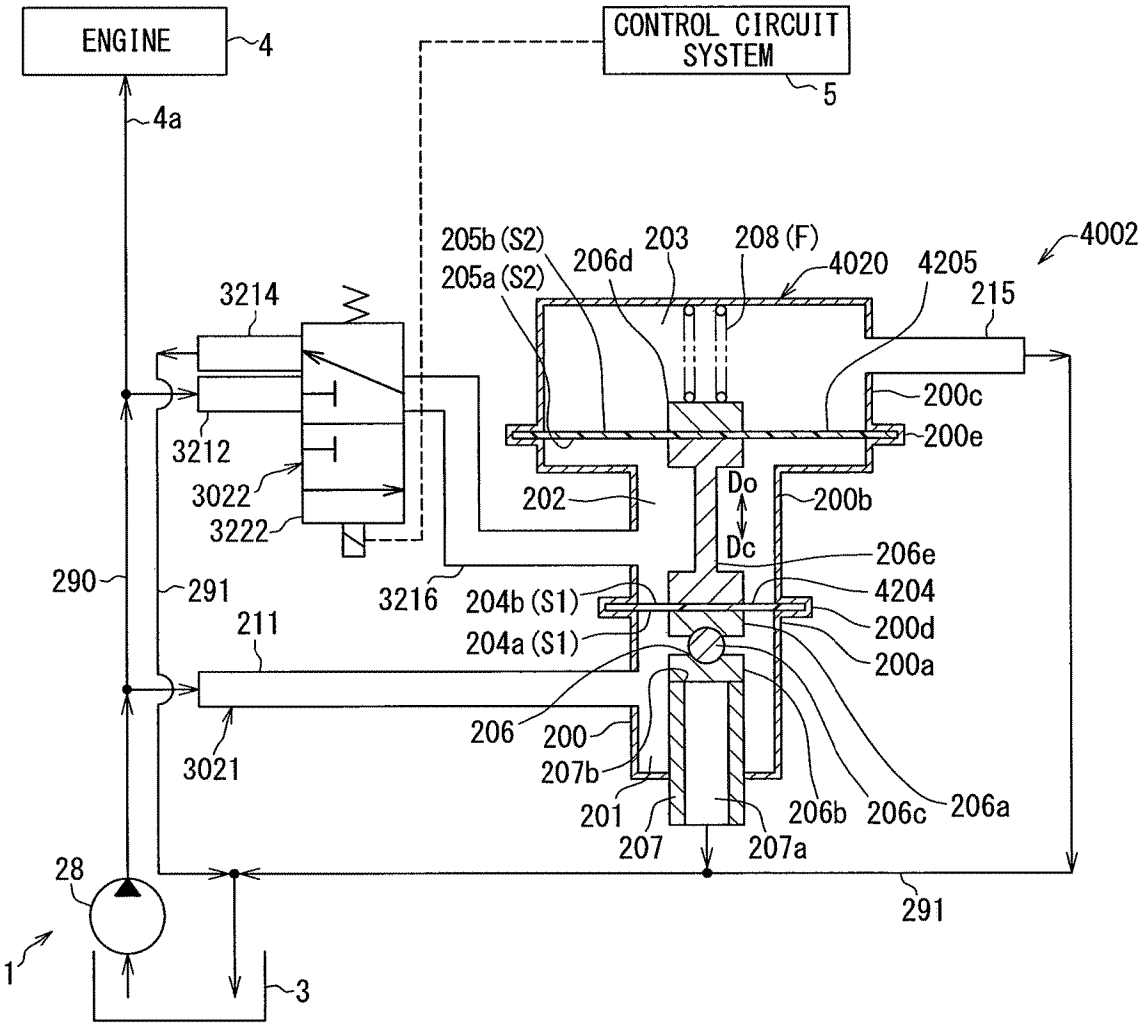
FIG. 15 is a detailed configuration diagram showing a pressure regulator according to at least one embodiment.

As shown in FIG. 15, a fourth embodiment of the present disclosure is a modification of the third embodiment.

In a main unit 4020 of a pressure regulator 4002 according to the fourth embodiment, a second pressure receiving area S2 of a second partition member 4205 is set in advance to a value larger than a first pressure receiving area S1 of a first partition member 4204. Therefore, an area comparison coefficient A represented by Expression 1 described in the embodiment has a value smaller than 1 in the fourth embodiment. As a result, in the fourth embodiment from Expressions 10 and 11 described in the third embodiment, fuel pressures P1 and P2 of a fuel flow passage 290 in modes M1 and M2 satisfy the following Expression 13. The main unit 4020 is the same as that described in the embodiment except for the above configurations.

$$P1>P2 \quad \text{(Expression 13)}$$

Therefore, the first mode M1 in which the fuel pressure in the fuel flow passage 290 becomes a fuel pressure P1 on a high-pressure side is executed, for example, at the time of restarting an internal combustion engine in which there is a need to reduce the vaporization of the fuel in the high temperature state. Therefore, in particular, in the fourth embodiment in which the energization to a second electromagnetic valve 3222 is stopped in the first mode M1 as in the third embodiment, the effect of reducing the vaporization of the fuel is enhanced because the switching unit 3022 enters the first mode M1 by stopping the energization not only at the time of restart but also in the stopped state of the internal combustion engine before restart. On the other hand, the second mode M2 in which the fuel pressure in the fuel flow passage 290 becomes the fuel pressure P2 on the low-pressure side is executed, for example, at the time of steady operation of the internal combustion engine in which there is a need to reduce the consumption of fuel and improve the fuel efficiency.

In the fourth embodiment described above, the first and second pressure chambers 201 and 202 adjacent to each other are partitioned from each other by the first partition member 4204, and the second and third pressure chambers 202 and 203 adjacent to each other are partitioned from each other by the second partition member 4205. In the above partition structure, when the switching unit 3022 switches the opening and closing state of the second pressure chamber 202 with respect to the fuel flow passage 290, the valve member 206 that opens and closes the first pressure chamber 201 with respect to the return passage 291 moves with the first and second partition members 4204 and 4205, thereby adjusting the fuel pressure in the fuel flow passage 290.

In this case, in the fourth embodiment, the switching unit 3022 described in the third embodiment switches the opening and closing state of the second pressure chamber 202 with respect to the fuel flow passage 290 and the opening and closing state of the second pressure chamber 202 with respect to the return passage 291 to the open-close relationships opposite to each other. Therefore, since the same operation as that of the third embodiment can be achieved, it is possible to improve the responsiveness and the pressure regulation accuracy together with the improvement in the fuel efficiency.

In addition, also in the fourth embodiment, the resilient member 208 urges the valve member 206 in the valve closing direction Dc. Further, in the fourth embodiment, the first and second partition members 4204 and 4205, which are diaphragms, provide the first and second pressure receiving areas S1 and S2 common to the first and second pressure chambers 201 and 202 in the urging structure, and the second pressure receiving area S2 is larger than the first pressure receiving area S1. Therefore, even if the first and second pressure receiving areas S1 and S2 are applied to the first and second partition members 4204 and 4205, respectively, in the configuration similar to the third embodiment of the units 3021 and 3022 according to the fourth embodiment, the fuel pressure in the fuel flow passage 290 can be reliably adjusted to a range of the positive pressure. Therefore, the reliability of the pressure regulator 4002 can be enhanced.

(Other Embodiments)

Although multiple embodiments of the present disclosure have been described above, the present disclosure is not construed as being limited to those embodiments, and can be applied to various embodiments and combinations within a scope that does not deviate from the spirit of the present disclosure.

More specifically, in Modification 1 relating to the embodiment, an area comparison coefficient A satisfying the following Expression 14 is employed, so that the fuel pressures P1, P2, and P3 of the fuel flow passage 290 in the respective modes M1, M2, and M3 may satisfy the following Expression 15.

$$A \geq 2 \quad \text{(Expression 14)}$$

$$P1 < P3 \leq P2 \quad \text{(Expression 15)}$$

In Modification 2 relating to the embodiment, any one of the first to third modes M1 to M3 may not be executed. In this case, in Modification 2 in which the first mode M1 is not executed, the opening and closing state of each of the second and third pressure chambers 202 and 203 with respect to the fuel flow passage 290 is switched only between the opposite open-close relationship opposite to each other.

Figure 16:
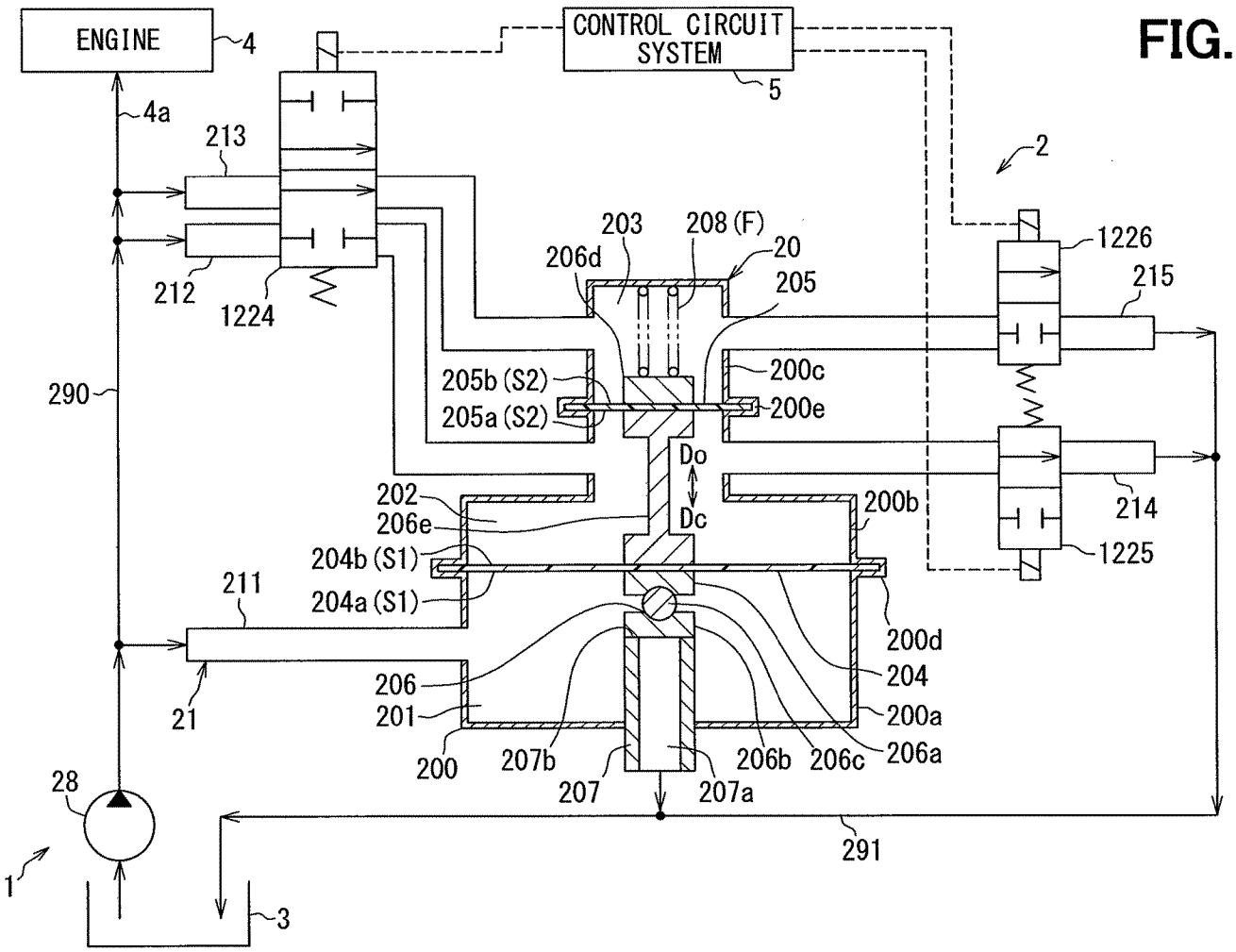
FIG. 16 is a detailed configuration diagram showing a pressure regulator according to at least one embodiment of FIG. 2.
Figure 17:
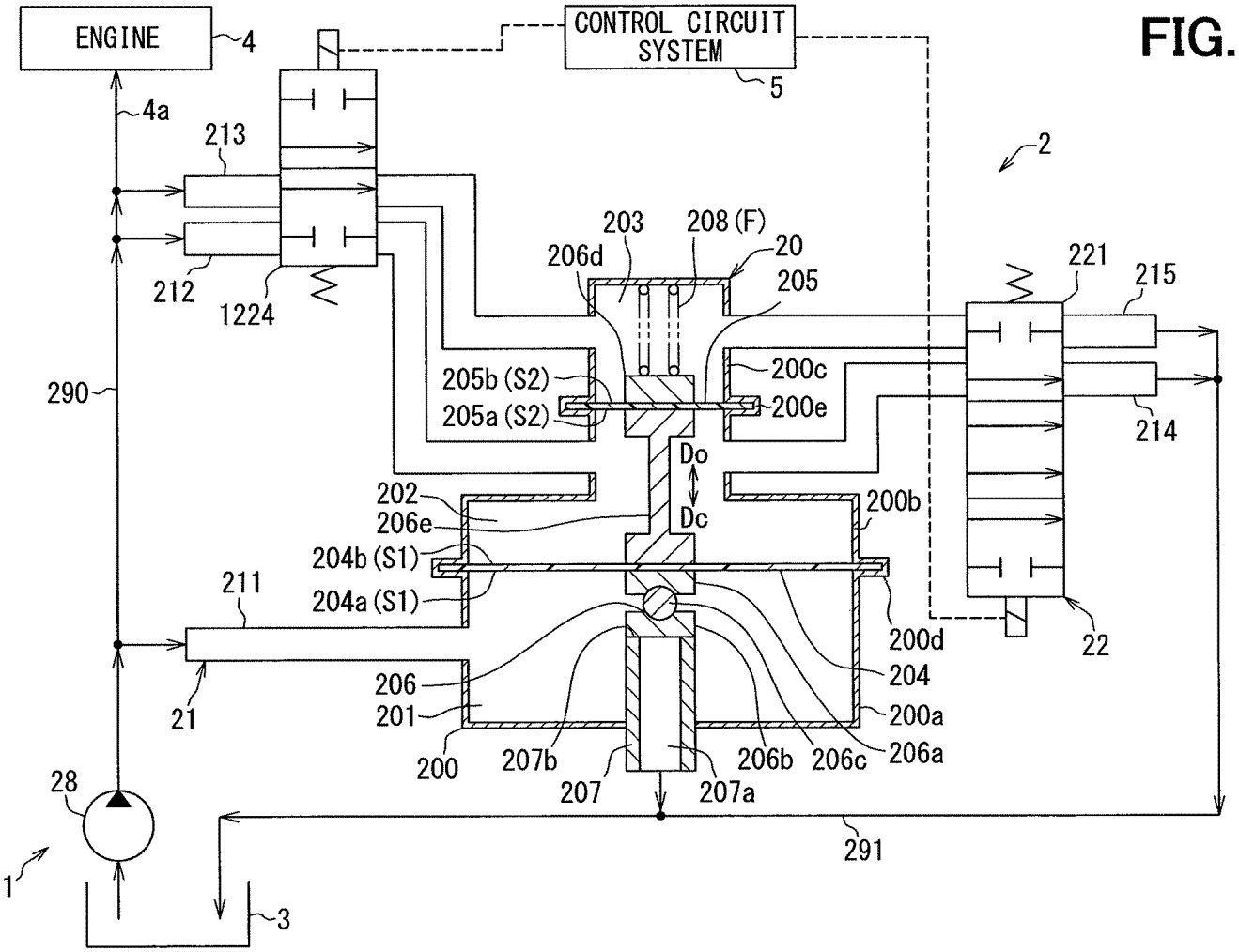
FIG. 17 is a detailed configuration diagram showing a pressure regulator according to at least one embodiment of FIG. 2.
Figure 18:
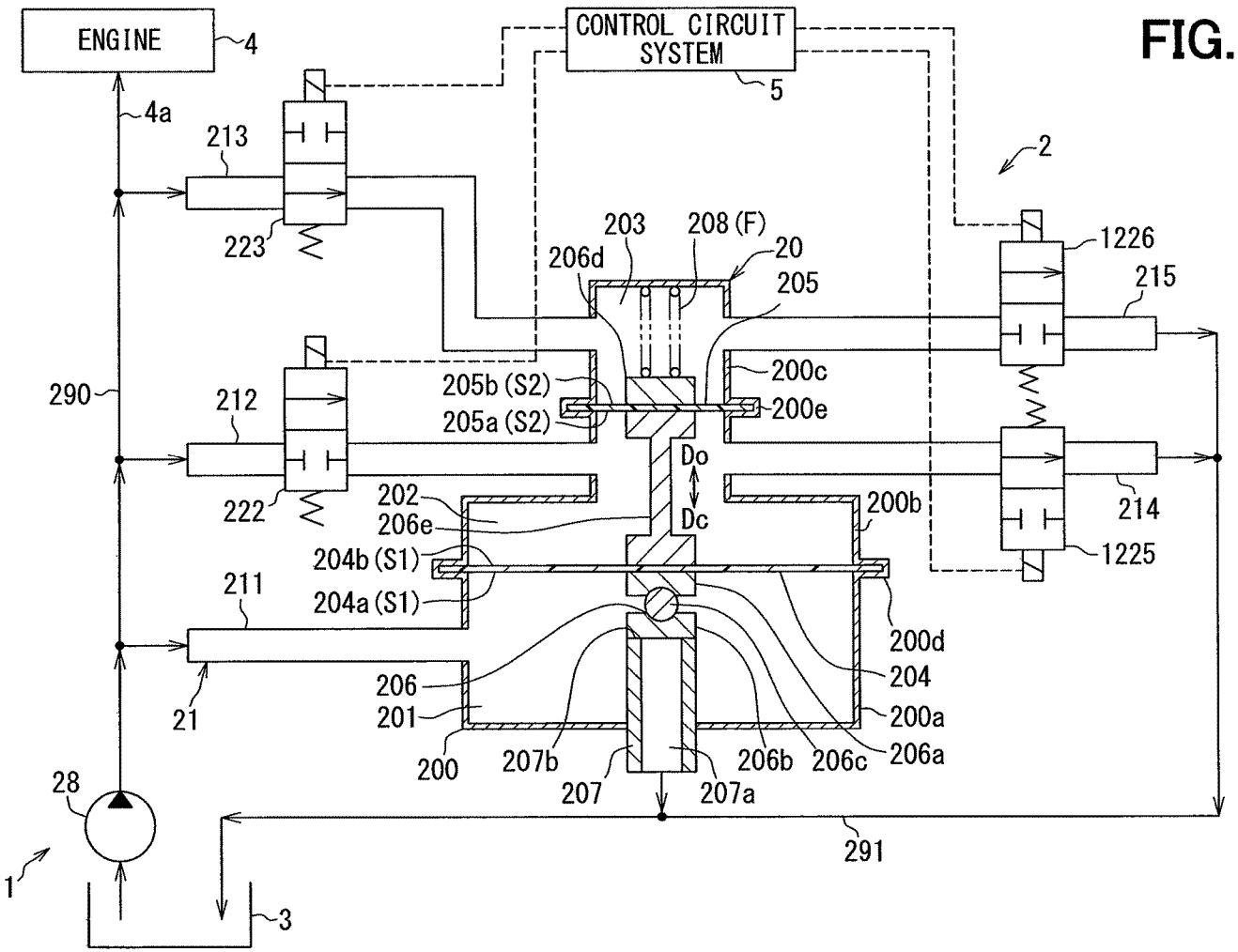
FIG. 18 is a detailed configuration diagram showing a pressure regulator according to at least one embodiment of FIG. 2.

In Modification 3 relating to the embodiment, as shown in FIGS. 16 and 17, the functions of the second and third electromagnetic valves 222 and 223 may be performed by an electromagnetic valve 1224 which is a four-port direction switching valve. In Modification 4 relating to the embodiment instead of or in addition to Modification 3, as shown in FIGS. 16 and 18, the function of the first electromagnetic valve 221 may be performed by a pair of electromagnetic valves 1225 and 1226, which are two-port direction switching valves.

Figure 19:
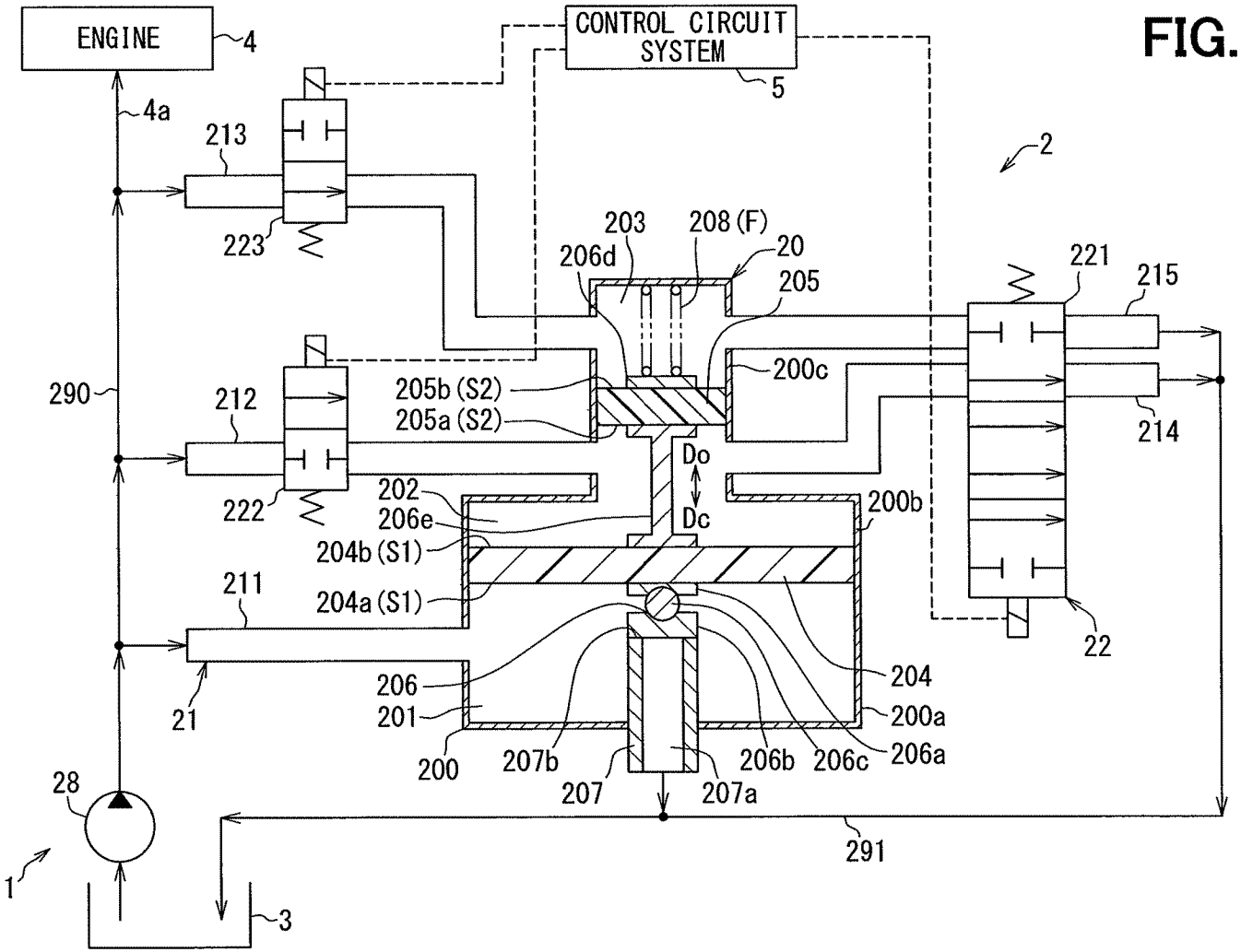
FIG. 19 is a detailed configuration diagram showing a pressure regulator according to yet at least one embodiment of FIG. 2.

In Modification 5 relating to the first to fourth embodiments, as shown in FIG. 19, the first partition members 204 and 4204 may be pistons that move with the valve member 206 in a state where the first and second pressure chambers 201 and 202 are partitioned from each other. In Modification 6 relating to the first to fourth embodiments instead of or in addition to Modification 5, as shown in FIG. 19, the second partition members 205 and 4205 may be pistons (for example, resin pistons in FIG. 19) movable with the valve member 206 and the first partition members 204 and 4204 in a state in which the second and third pressure chambers 202 and 203 are partitioned from each other. FIG. 19 representatively shows Modifications 5 and 6 relating to the embodiment.

Figure 20:
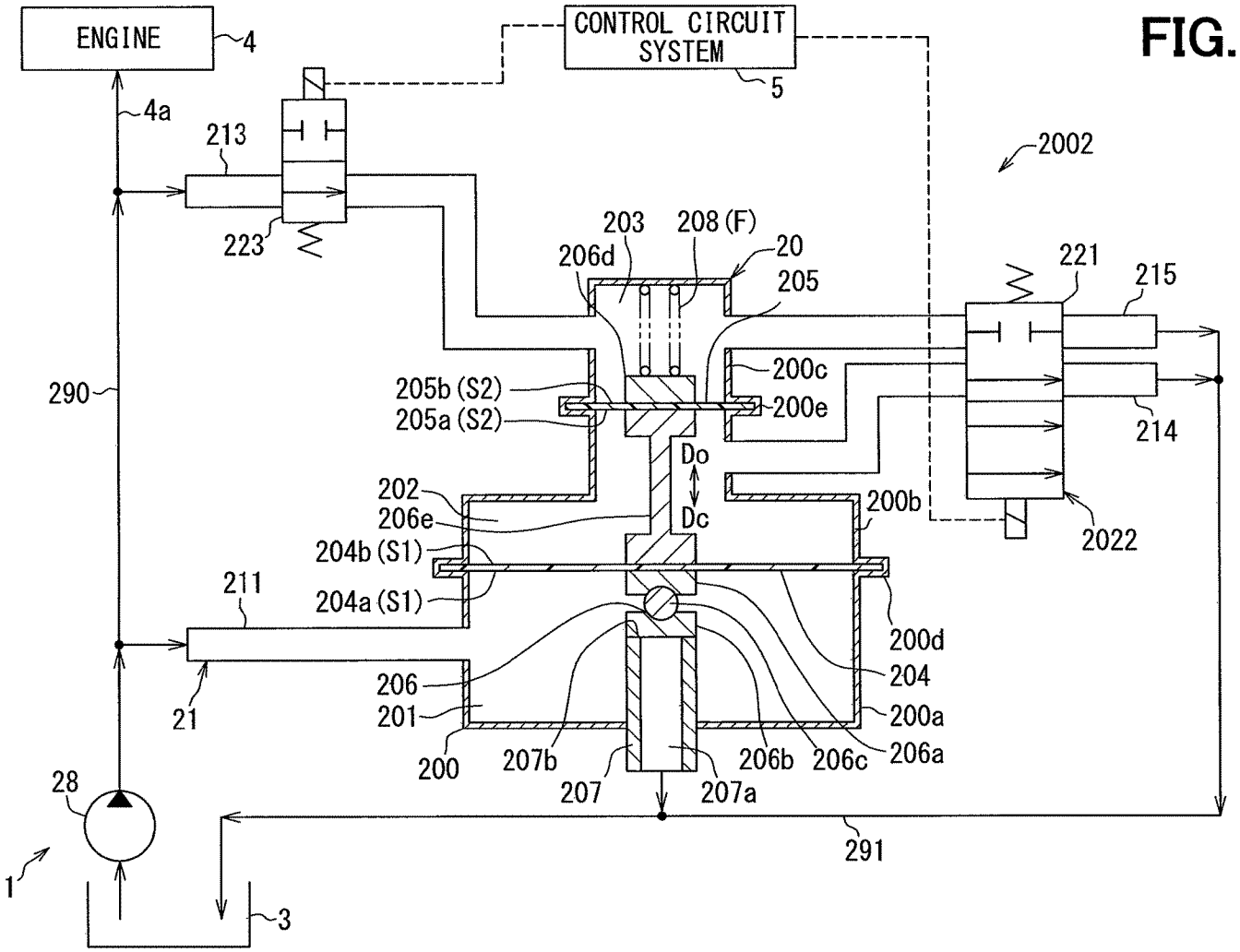
FIG. 20 is a detailed configuration diagram showing a pressure regulator according to at least one embodiment of FIG. 7.
Figure 21:
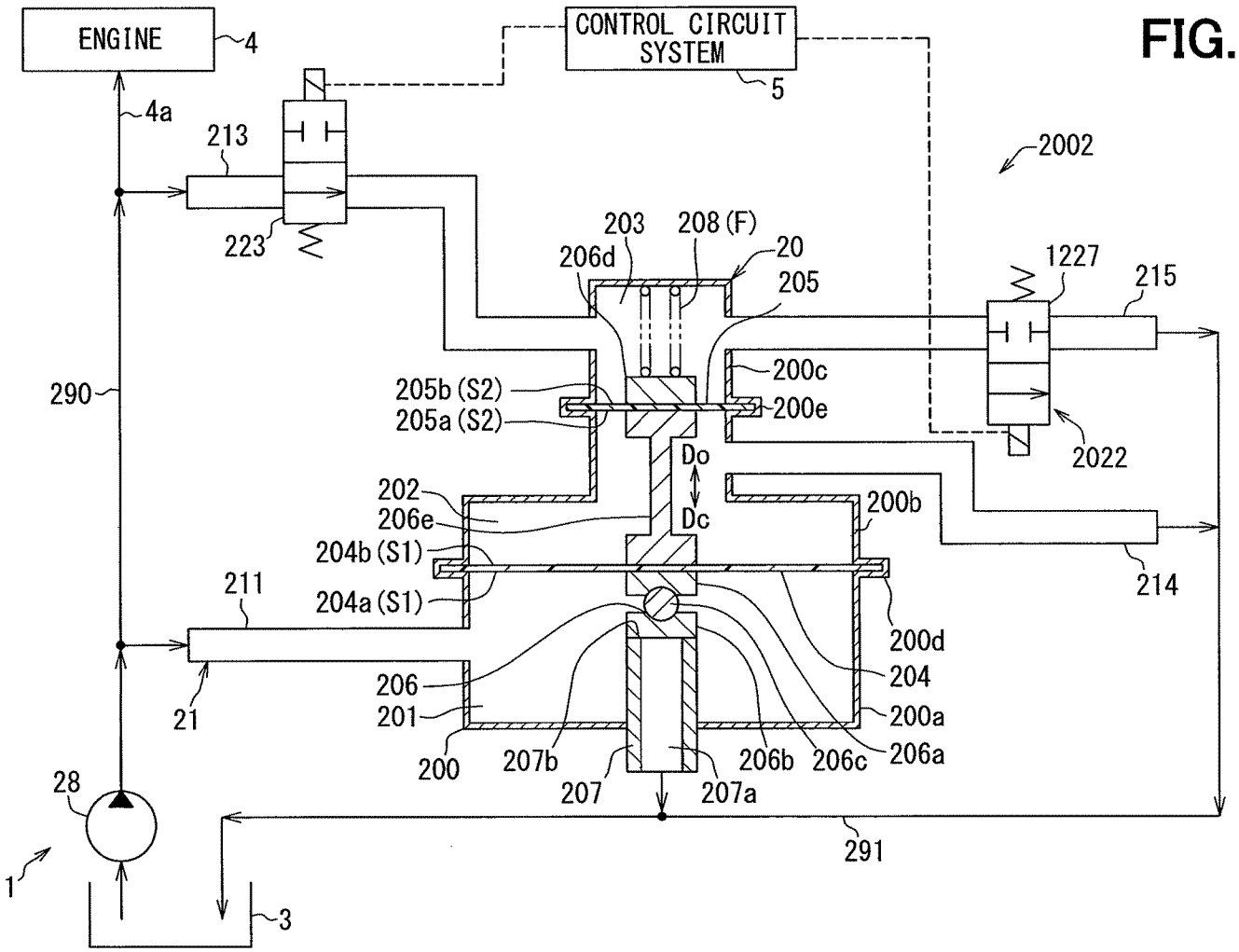
FIG. 21 is a detailed configuration diagram showing a pressure regulator according to at least one embodiment of FIG. 7.

In Modification 7 relating to the embodiment, as shown in FIG. 20, the function of the third electromagnetic valve 2223 in the configuration of the passage unit 21 according to the embodiment may be performed by the third electromagnetic valve 223 according to the embodiment and the first electromagnetic valve 221 according to the embodiment except for the absence of the second mode M2. Alternatively, in Modification 8 relating to the embodiment, in the configuration of the passage unit 21 according to the embodiment, as shown in FIG. 21, the function of the third electromagnetic valve 2223 may be performed by the third electromagnetic valve 223 according to the embodiment and the electromagnetic valve 1227 which is a two-port type direction switching valve provided in the middle portion of the third release passage 215.

Figure 22:
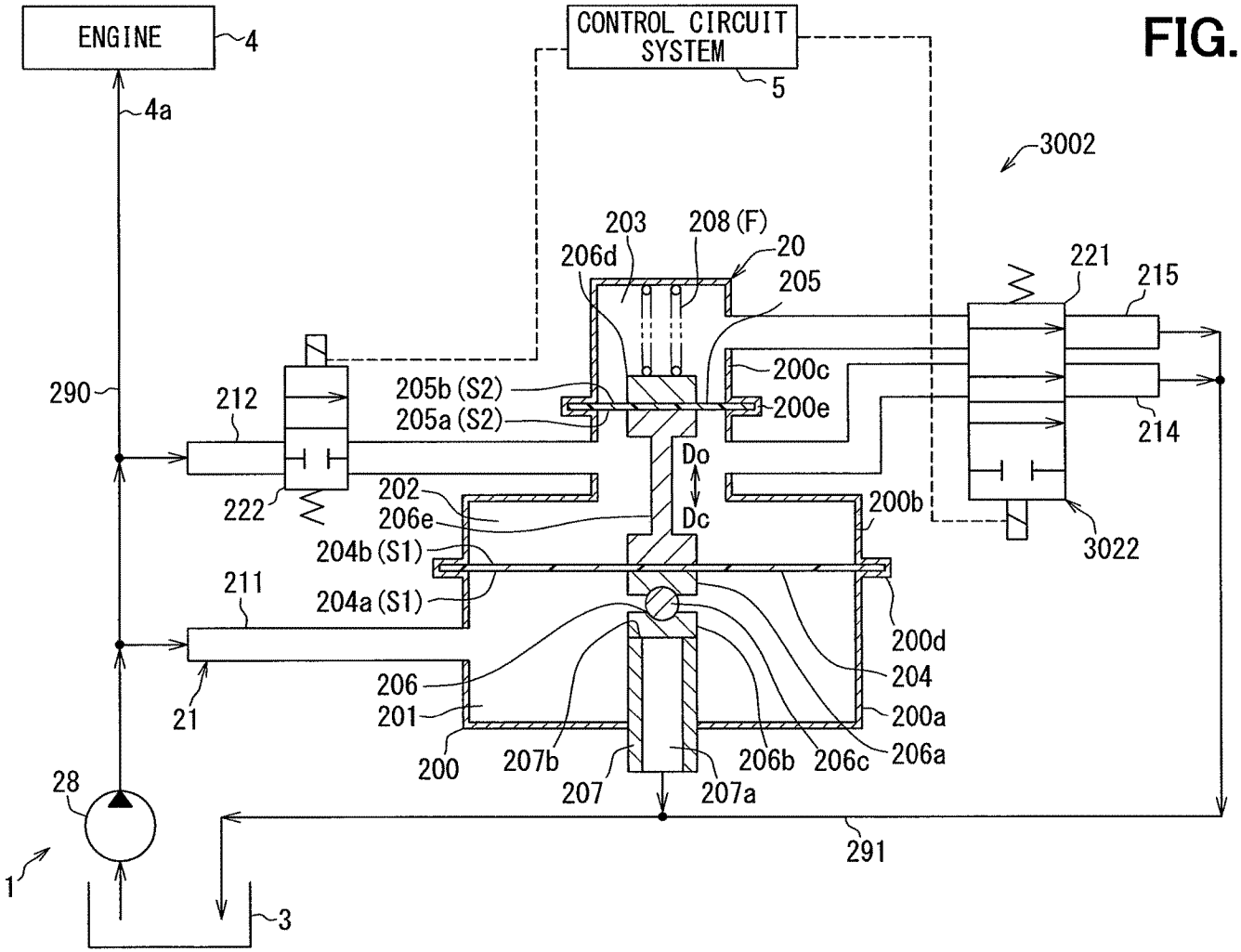
FIG. 22 is a detailed configuration diagram showing a pressure regulator according to at least one embodiment of FIG. 11.
Figure 23:
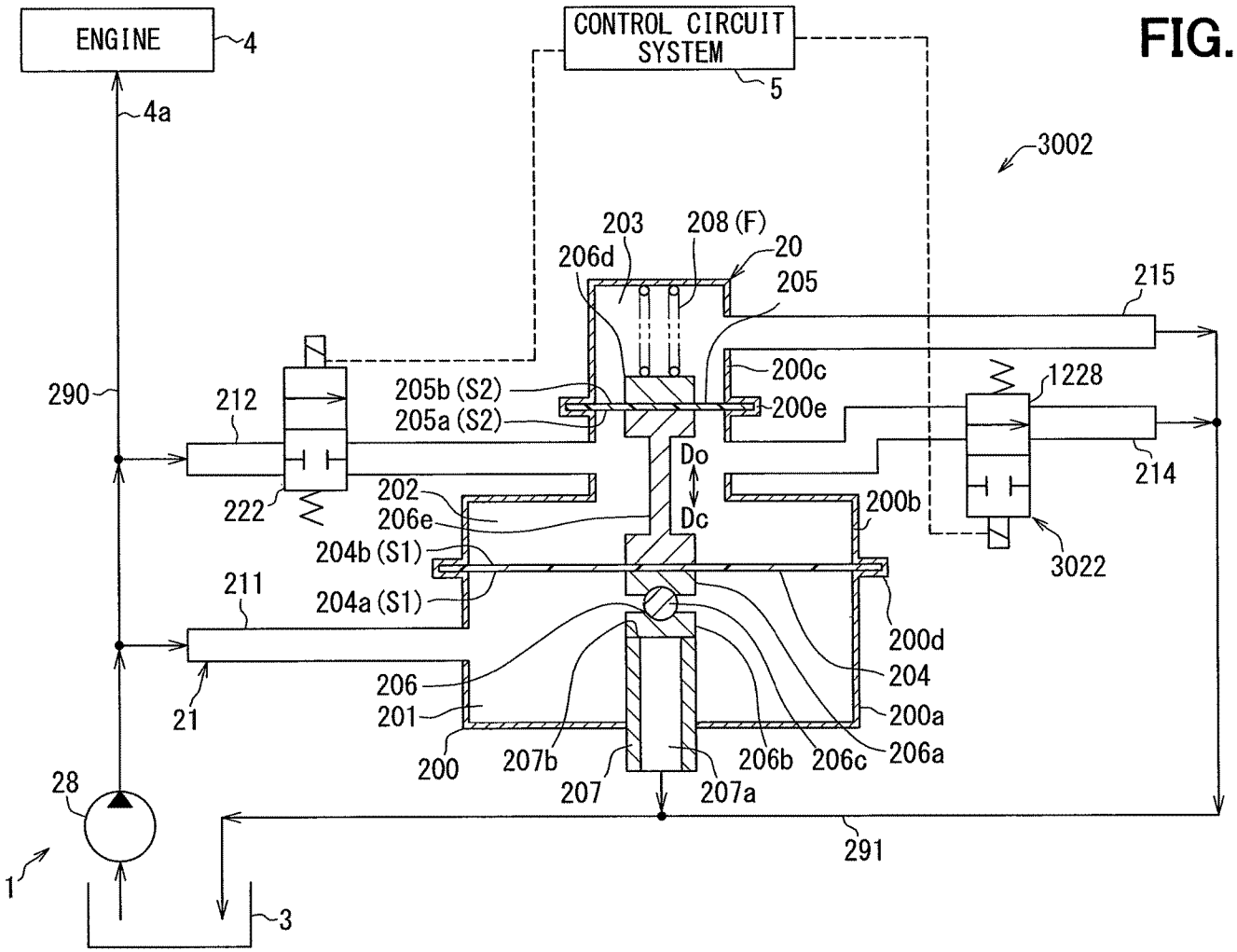
FIG. 23 is a detailed configuration diagram showing a pressure regulator according to at least one embodiment of FIG. 11.

In Modification 9 relating to the third and fourth embodiments, as shown in FIG. 22, the function of the second electromagnetic valve 3222 in the configuration of the passage unit 21 according to the embodiment may be performed by the second electromagnetic valve 222 according to the embodiment and the first electromagnetic valve 221 according to the embodiment except for the absence of the third mode M3. Alternatively, in Modification 10 relating to the third embodiment, as shown in FIG. 23, in the configuration of the passage unit 21 according to the embodiment, the function of the second electromagnetic valve 3222 may be performed by the second electromagnetic valve 222 according to the embodiment and the electromagnetic valve 1228 which is a two-port type direction switching valve provided in the middle portion of the second release passage 214. FIGS. 22 and 23 representatively show Modifications 9 and 10 relating to the third embodiment, respectively.

Figure 24:
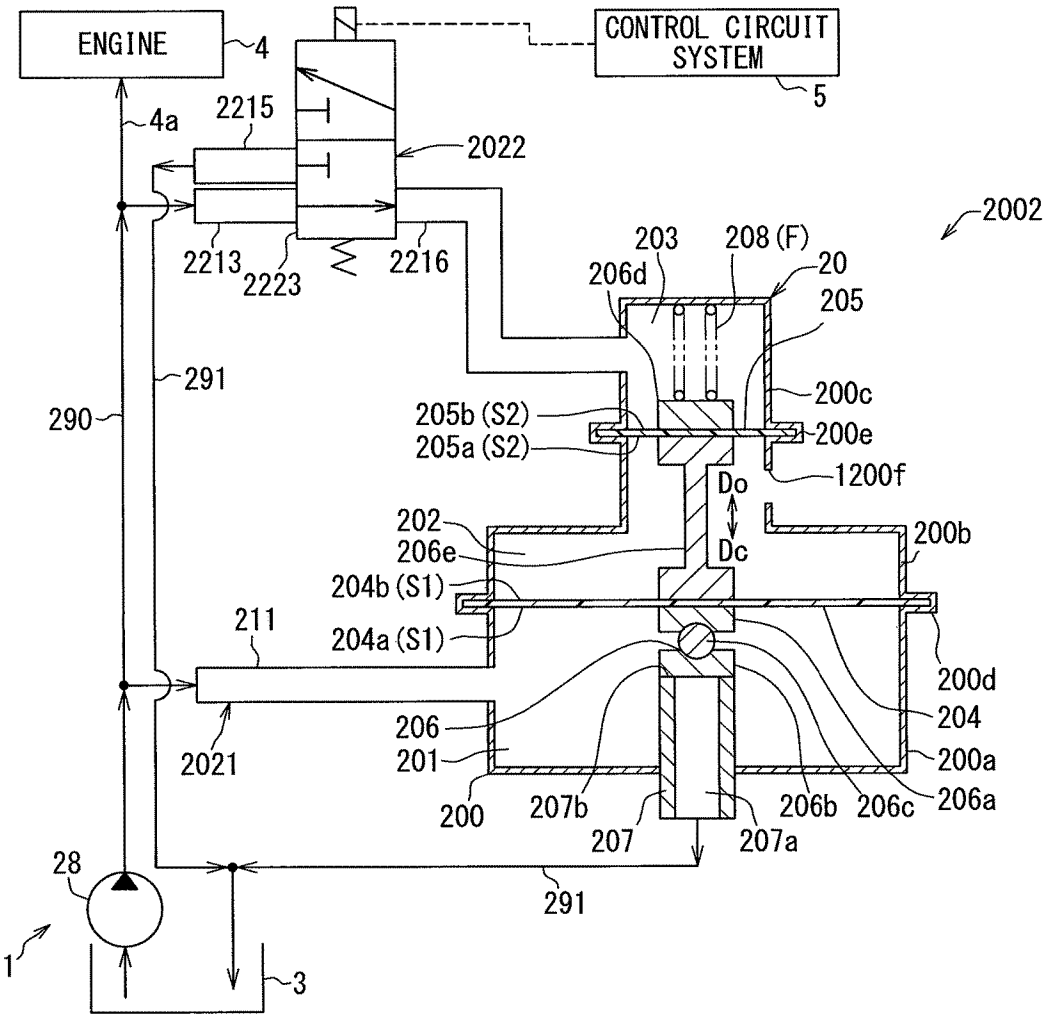
FIG. 24 is a detailed configuration diagram showing a pressure regulator according to at least one embodiment of FIG. 7.
Figure 25:
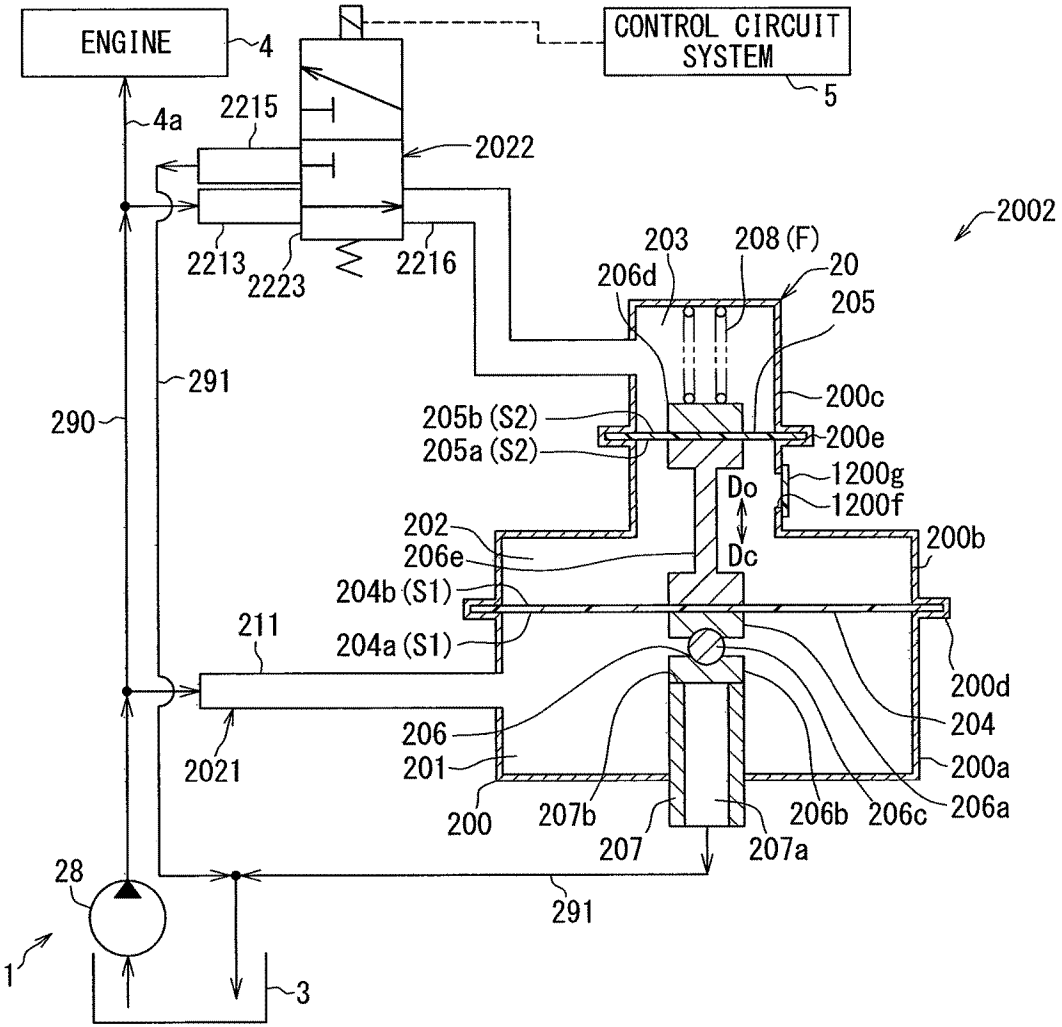
FIG. 25 is a detailed configuration diagram showing a pressure regulator according to at least one embodiment of FIG. 7.

In Modification 11 relating to the embodiment, as shown in FIG. 24, the second release passage 214 may not be provided, and the second pressure chamber 202 may be opened to the atmosphere through a through hole 1200*f* penetrating through the second cylindrical portion 200*b*. Alternatively, in Modification 12 relating to the embodiment, as shown in FIG. 25, the second release passage 214 may not be provided, and the through hole 1200*f* penetrating through the second cylindrical portion 200*b* may be covered with a diaphragm 1200*g* which is elastically deformable.

Figure 26:
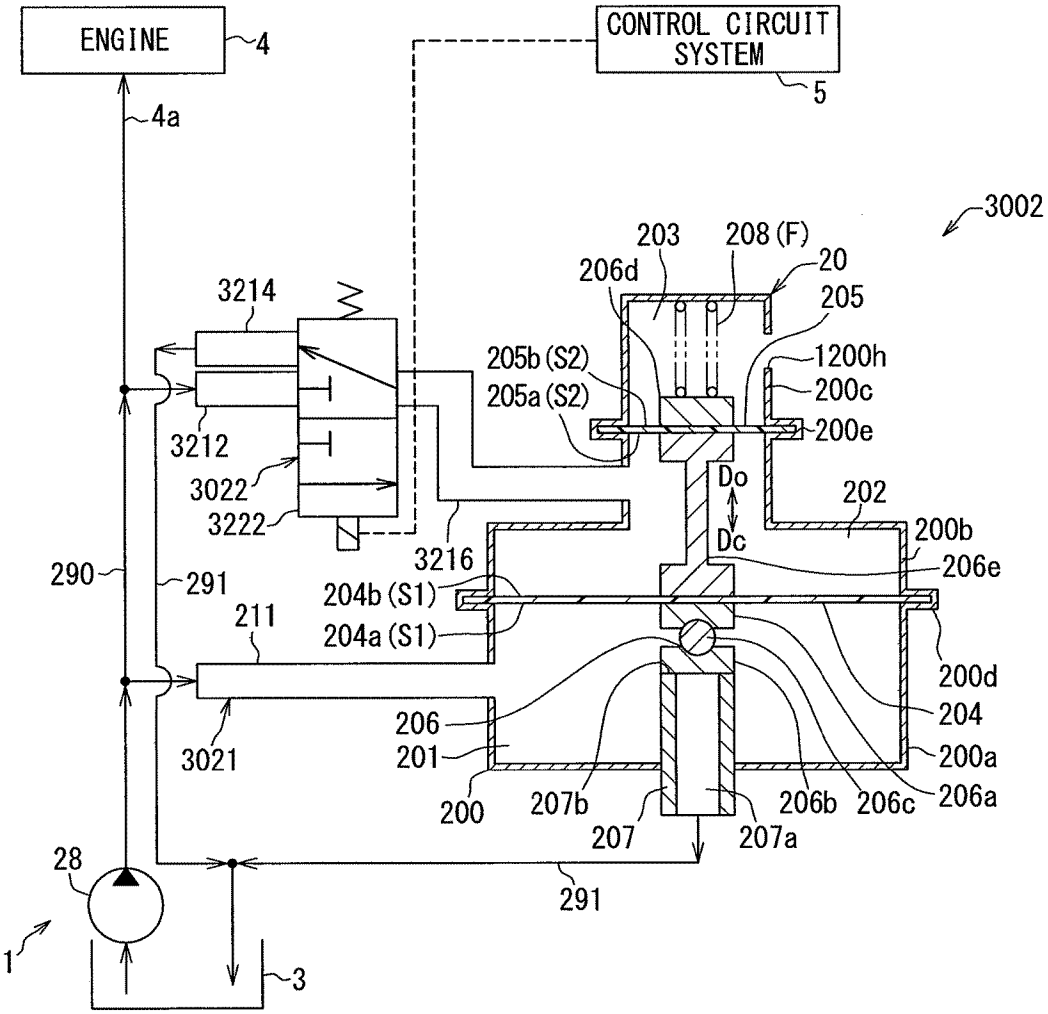
FIG. 26 is a detailed configuration diagram showing a pressure regulator according to at least one embodiment of FIG. 11.
Figure 27:
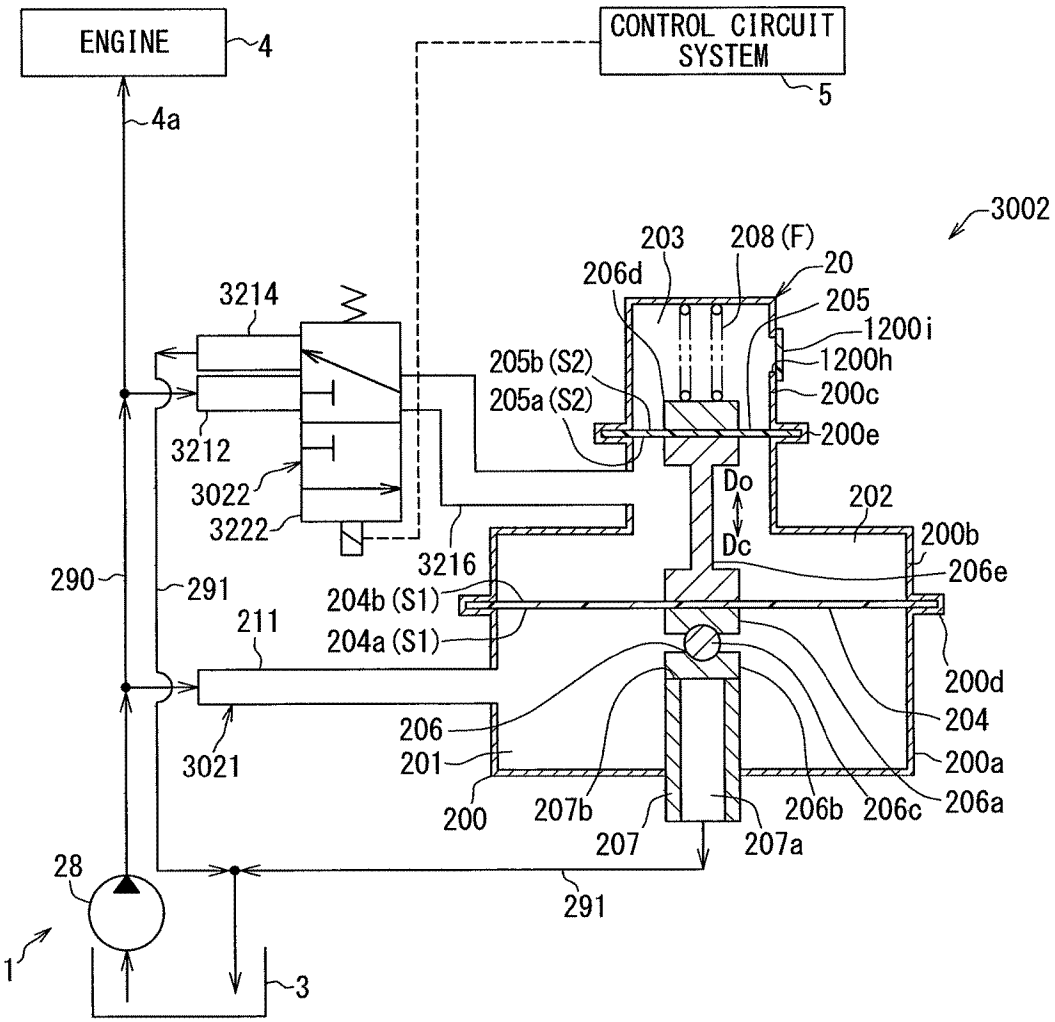
FIG. 27 is a detailed configuration diagram showing a pressure regulator according to at least one embodiment of FIG. 11.

In Modification 13 relating to the third and fourth embodiments, as shown in FIG. 26, the third release passage 215 may not be provided, and the third pressure chamber 203 may be opened to the atmosphere through a through hole 1200*h* penetrating through the third cylindrical portion 200*c*. Alternatively, in Modification 14 relating to the third and fourth embodiments, as shown in FIG. 27, the third release passage 215 may not be provided, and the through hole 1200*h* penetrating through the third cylindrical portion 200*c* may be covered with a diaphragm 1200*i* which is elastically deformable. FIGS. 26 and 27 representatively show Modifications 13 and 14 relating to the third embodiment, respectively.

The pressure regulator 2 according to the first disclosure described above adjusts the fuel pressures P1, P2, and P3 of the fuel flow passages by releasing the fuel from the fuel flow passage 290 allowing the fuel pumped by the fuel pump 28 in the fuel tank 3 to flow toward the internal combustion engine 4 side into the fuel tank through the return passage 291. The pressure regulator 2 includes a first pressure chamber 201, a second pressure chamber 202, a third pressure chamber 203, a valve member 206, a first partition member 204, a second partition member 205, and a switching unit 22. The fuel branched from the fuel flow passage flows into the first pressure chamber 201. The second pressure chamber 202 is adjacent to the first pressure chamber, and the fuel branched from the fuel flow passage flows into the second pressure chamber 202. The third pressure chamber 203 is adjacent to the second pressure chamber, and the fuel branched from the fuel flow passage flows into the third pressure chamber 203. The valve member 206 opens and closes the first pressure chamber with respect to the return passage. The first partition member 204 moves with the valve member in a state where the first pressure chamber and the second pressure chamber are partitioned from each other. The second partition member 205 moves with the valve member and the first partition member in a state where the second pressure chamber and the third pressure chamber are partitioned from each other. The switching unit 22 switches the opening and closing state of the second pressure chamber with respect to the fuel flow passage and the opening and closing state of the second pressure chamber with respect to the return passage into the open-close relationship opposite to each other, and switches the opening and closing state of the third pressure chamber with respect to the fuel flow passage and the opening and closing state of the third pressure chamber with respect to the return passage into the open-close relationship opposite to each other.

According to the first disclosure, the adjacent first and second pressure chambers are partitioned from each other by the first partition member, and the adjacent second and third pressure chambers are partitioned from each other by the second partition member. In such a partition structure, when the switching unit switches the opening and closing state of each of the second and third pressure chambers with respect to the fuel flow passage, the valve member for opening and closing the first pressure chamber with respect to the return passage moves with the first and second partition members to adjust the fuel pressure in the fuel flow passage.

In the second pressure chamber according to the first disclosure, the switching unit switches the opening and closing state with respect to the fuel flow passage and the opening and closing state with respect to the return passage to the open-close relationship opposite to each other. Therefore, in the second pressure chamber, a situation in which the fuel pump is forced to perform extra work can be avoided by switching to the closed state for the return passage, while a change from the fuel pressure before the switching can quickly occur each time the opening and closing state for the fuel flow passage and the return passage is switched.

Similarly, in the third pressure chamber according to the first disclosure, the switching unit switches the opening and closing state with respect to the fuel flow passage and the opening and closing state with respect to the return passage to the open-close relationship opposite to each other. Therefore, also in the third pressure chamber, a situation in which the fuel pump is forced to perform extra work can be avoided by switching to the closed state for the return passage, while a change from the fuel pressure before the switching can quickly occur each time the opening and closing state for the fuel flow passage and the return passage is switched.

Therefore, according to the first disclosure capable of exhibiting the above-mentioned functions, it is possible to improve the responsiveness and the pressure regulation accuracy in balance with the improvement of the fuel efficiency.

In addition, the pressure regulator 2002 according to the second disclosure described above adjusts the fuel pressures P1 and P2 of the fuel flow passages by releasing the fuel from the fuel flow passage 290 allowing the fuel pumped by the fuel pump 28 in the fuel tank 3 to flow toward the internal combustion engine 4 side into the fuel tank through the return passage 291. The pressure regulator 2002 includes the first pressure chamber 201, the second pressure chamber 202, the third pressure chamber 203, the valve member 206, the first partition member 204, the second partition member 205, and the switching unit 2022. The fuel branched from the fuel flow passage flows into the first pressure chamber 201. The second pressure chamber 202 is adjacent to the first pressure chamber, and the fuel branched from the fuel flow passage flows into the second pressure chamber 202. The third pressure chamber 203 is adjacent to the second pressure chamber, and the fuel branched from the fuel flow passage flows into the third pressure chamber 203. The valve member 206 opens and closes the first pressure chamber with respect to the return passage. The first partition member 204 moves with the valve member in a state where the first pressure chamber and the second pressure chamber are partitioned from each other. The second partition member 205 moves with the valve member and the first partition member in a state where the second pressure chamber and the third pressure chamber are partitioned from each other. The switching unit 2022 switches the opening and closing state of the third pressure chamber with respect to the fuel flow passage and the opening and closing state of the third pressure chamber with respect to the return passage to the open-close relationship opposite to each other.

According to the second disclosure, the adjacent first and second pressure chambers are partitioned from each other by the first partition member, and the adjacent second and third pressure chambers are partitioned from each other by the second partition member. In the above partition structure, when the switching unit switches the opening and closing state of the third pressure chamber with respect to the fuel flow passage, the valve member that opens or closes the first pressure chamber with respect to the return passage moves with the first and second partition members and to adjust the fuel pressure in the fuel flow passage.

In the third pressure chamber according to the second disclosure, the switching unit switches the opening and closing state with respect to the fuel flow passage and the opening and closing state with respect to the return passage to the open-close relationship opposite to each other. Thus, in the third pressure chamber, a situation in which an extra work is forced on the fuel pump can be avoided by switching to the closed state with respect to the return passage, while a change from the fuel pressure before switching can quickly occur at each switching of the opening and closing state with respect to the fuel flow passage and the return passage.

Therefore, according to the second disclosure capable of exhibiting the functions described above, it is possible to improve the responsiveness and the pressure regulation accuracy together with the improvement in the fuel efficiency.

In addition, the pressure regulators 3002 and 4002 according to the third disclosure described above adjusts the fuel pressures P1 and P2 of the fuel flow passages by releasing the fuel from the fuel flow passage 290 allowing the fuel pumped by the fuel pump 28 in the fuel tank 3 to flow toward the internal combustion engine 4 side into the fuel tank through the return passage 291. The pressure regulators 3002 and 4002 include the first pressure chamber 201, the second pressure chamber 202, the third pressure chamber 203, the valve member 206, first partition members 204 and 4204, second partition members 205 and 4205, and the switching unit 3022. The fuel branched from the fuel flow passage flows into the first pressure chamber 201. The second pressure chamber 202 is adjacent to the first pressure chamber, and the fuel branched from the fuel flow passage flows into the second pressure chamber 202. The third pressure chamber 203 is adjacent to the second pressure chamber, and the fuel branched from the fuel flow passage flows into the third pressure chamber 203. The valve member 206 opens and closes the first pressure chamber with respect to the return passage. The first partition members 204 and 4204 move with the valve member in a state where the first pressure chamber and the second pressure chamber are partitioned from each other. The second partition members 205 and 4205 move with the valve member and the first partition member in a state where the second pressure chamber and the third pressure chamber are partitioned from each other. The switching unit 3022 switches the opening and closing state of the second pressure chamber with respect to the fuel flow passage and the opening and closing state of the second pressure chamber with respect to the return passage to the open-close relationship opposite to each other.

According to the third disclosure, the adjacent first and second pressure chambers are partitioned from each other by the first partition member, and the adjacent second and third pressure chambers are partitioned from each other by the second partition member. In the above partition structure, when the switching unit switches the opening and closing state of the second pressure chamber with respect to the fuel flow passage, the valve member that opens or closes the first pressure chamber with respect to the return passage moves with the first and second partition members to adjust the fuel pressure in the fuel flow passage.

In the second pressure chamber according to the third disclosure, the switching unit switches the opening and closing state with respect to the fuel flow passage and the opening and closing state with respect to the return passage to the open-close relationship opposite to each other. Therefore, in the second pressure chamber, a situation in which the fuel pump is forced to perform extra work can be avoided by switching to the closed state for the return passage, while a change from the fuel pressure before the switching can quickly occur each time the opening and closing state for the fuel flow passage and the return passage is switched.

Therefore, according to the third disclosure capable of exhibiting the functions described above, it is possible to improve the responsiveness and the pressure regulation accuracy together with the improvement in the fuel efficiency.

Furthermore, the fuel supply device according to the fourth disclosure described above includes the fuel pump 28, the fuel flow passage 290, the return passage 291, and any one of the pressure regulators 2, 2002, 3002, and 4002 of the first to third disclosures. The fuel pump 28 pumps up the fuel in the fuel tank 3. The fuel flow passage 290 allows the fuel pumped by the fuel pump to flow toward the internal combustion engine 4. The return passage 291 allows the fuel to release into the fuel tank. The pressure regulator 2, 2002, 3002, or 4002 of any of the first to third disclosures adjusts the fuel pressure P1, P2, and P3 of the fuel flow passage by releasing the fuel from the fuel flow passage to the return passage.

In the fourth disclosure, it is possible to improve the responsiveness and the pressure regulation accuracy together with the improvement in the fuel efficiency by the above-mentioned action of any one of the first to third disclosures including the pressure regulator.

Although the present disclosure has been described in accordance with the examples, it is understood that the disclosure is not limited to such examples or structures. The present disclosure encompasses various modifications and variations within the scope of equivalents. In addition, various combinations and configurations, as well as other combinations and configurations that include only one element, more, or less, are within the scope and spirit of the present disclosure.

The invention claimed is:

1. A pressure regulator configured to release fuel from a fuel flow passage into a fuel tank through a return passage to regulate a fuel pressure in the fuel flow passage, the fuel flow passage being configured to cause fuel pumped by a fuel pump in the fuel tank to flow toward an internal combustion engine, the pressure regulator comprising:

a first pressure chamber configured to cause fuel branched from the fuel flow passage to flow therethrough;

a second pressure chamber adjacent to the first pressure chamber and configured to cause fuel branched from the fuel flow passage to flow therethrough;

a third pressure chamber adjacent to the second pressure chamber and configured to cause fuel branched from the fuel flow passage to flow therethrough;

a valve member configured to open and close the first pressure chamber with respect to the return passage;

a first partition member configured to move with the valve member and partition the first pressure chamber and the second pressure chamber from each other;

a second partition member configured to move with the valve member and the first partition member and partition the second pressure chamber and the third pressure chamber from each other; and a switching unit configured to switch an opening and closing state of the second pressure chamber with respect to the fuel flow passage and an opening and closing state of the second pressure chamber with respect to the return passage in an open-close relationship opposite to each other, to switch an opening and closing state of the third pressure chamber with respect to the fuel flow passage and an opening and closing state of the third pressure chamber with respect to the return passage into an open-close relationship opposite to each other, and to switch an opening and closing state of the second pressure chamber with respect to the return passage and the opening and closing state of the third pressure chamber with respect to the return passage into an open-close relationship opposite to each other, wherein the switching unit is a valve device having a fuel passage therein and configured to simultaneously communicate the fuel flow passage with one of the second pressure chamber and the third pressure chamber, discommunicate the return passage with the one of the second pressure chamber and the third pressure chamber, communicate the return passage with another of the second pressure chamber and the third pressure chamber, and discommunicate the fuel flow passage with the other of the second pressure chamber and the third pressure chamber.

2. The pressure regulator according to claim 1, wherein the switching unit is configured to switch the opening and closing state of the second pressure chamber with respect to the fuel flow passage and the opening and closing state of the third pressure chamber with respect to the fuel flow passage into the open-close relationship opposite to each other.

3. The pressure regulator according to claim 2, wherein the switching unit is configured to switch the opening and closing state of the second pressure chamber with respect to the fuel flow passage and the opening and closing state of the third pressure chamber with respect to the fuel flow passage between the open-close relationship opposite to each other and a common closed state.

4. A pressure regulator configured to release fuel from a fuel flow passage into a fuel tank through a return passage to regulate a fuel pressure in the fuel flow passage, the fuel flow passage being configured to cause fuel pumped by a fuel pump from the fuel tank to flow toward an internal combustion engine, the pressure regulator comprising:

a first pressure chamber configured to cause fuel branched from the fuel flow passage to flow therethrough;

a second pressure chamber adjacent to the first pressure chamber and at atmospheric pressure;

a third pressure chamber adjacent to the second pressure chamber and configured to cause fuel branched from the fuel flow passage to flow therethrough;

a valve member configured to open and close the first pressure chamber with respect to the return passage;

a first partition member configured to move with the valve member and partition the first pressure chamber and the second pressure chamber from each other;

a second partition member configured to move with the valve member and the first partition member and partition the second pressure chamber and the third pressure chamber from each other; and a switching unit configured to switch an opening and closing state of the third pressure chamber with respect to the fuel flow passage and an opening and closing state of the third pressure chamber with respect to the return passage into an open-close relationship opposite to each other, wherein the switching unit is a valve device having a fuel passage therein, the switching unit is configured to simultaneously communicate the fuel flow passage with the third pressure chamber and discommunicate the return passage from the third pressure chamber, and the switching unit is configured to simultaneously communicate the return passage with the third pressure chamber and discommunicate the fuel flow passage from the third pressure chamber.

5. A pressure regulator configured to release fuel from a fuel flow passage into a fuel tank through a return passage to regulate a fuel pressure in the fuel flow passage, the fuel flow passage being configured to cause fuel pumped by a fuel pump from the fuel tank to flow toward an internal combustion engine, the pressure regulator comprising:

a first pressure chamber configured to cause fuel branched from the fuel flow passage to flow therethrough;

a second pressure chamber adjacent to the first pressure chamber and at atmospheric pressure;

a third pressure chamber adjacent to the second pressure chamber and configured to cause fuel branched from the fuel flow passage to flow therethrough;

a valve member configured to open and close the first pressure chamber with respect to the return passage;

a first partition member configured to move with the valve member and partition the first pressure chamber and the second pressure chamber from each other;

a second partition member configured to move with the valve member and the first partition member and partition the second pressure chamber and the third pressure chamber from each other; and a switching unit configured to switch an opening and closing state of the second pressure chamber with respect to the fuel flow passage and an opening and closing state of the second pressure chamber with respect to the return passage in an open-close relationship opposite to each other, wherein the switching unit is a valve device having a fuel passage therein, the switching unit is configured to simultaneously communicate the fuel flow passage with the second pressure chamber and discommunicate the return passage from the second pressure chamber, and the switching unit is configured to simultaneously communicate the return passage with the second pressure chamber and discommunicate the fuel flow passage from the second pressure chamber.

6. A fuel supply device comprising:

the pressure regulator according to claim 1;

the fuel tank configured to pump fuel from the fuel tank; and the fuel flow passage.

7. The pressure regulator according to claim 1, wherein the valve device includes a first valve device and second valve device, the first valve device includes a first movable valve body having a first passage that is part of the fuel passage and is configured to communicate with the fuel flow passage, and the second valve device includes a second movable valve body having a second passage that is part of the fuel passage and is configured to communicate with the return passage.

8. The pressure regulator according to claim 7, wherein the first valve device includes a first electromagnetic device configured to be electrically manipulated to move the first movable body, and the second valve device includes a second electromagnetic device configured to be electrically manipulated to move the second movable body.

9. The pressure regulator according to claim 4, wherein the valve device includes a movable valve body having a first passage that is part of the fuel passage and is configured to communicate with the fuel flow passage and having a second passage that is part of the fuel passage and is configured to communicate with the return passage.

10. The pressure regulator according to claim 9, wherein the valve device includes an electromagnetic device configured to be electrically manipulated to move the movable body.

11. The pressure regulator according to claim 5, wherein the valve device includes a first valve device and second valve device, the first valve device includes a first movable valve body having a first passage that is part of the fuel passage is configured to communicate with the fuel flow passage, and the second valve device includes a second movable valve body having a second passage that is part of the fuel passage and is configured to communicate with the return passage.

12. The pressure regulator according to claim 11, wherein the first valve device includes a first electromagnetic device configured to be electrically manipulated to move the first movable body, and the second valve device includes a second electromagnetic device configured to be electrically manipulated to move the second movable body.

* * * * *